US012064048B1

(12) United States Patent
Lehtonen

(10) Patent No.: US 12,064,048 B1
(45) Date of Patent: Aug. 20, 2024

(54) SUPPORT FOR A PURSE

(71) Applicant: Donna Lee Elizabeth Lehtonen, Schomberg (CA)

(72) Inventor: Donna Lee Elizabeth Lehtonen, Schomberg (CA)

(73) Assignee: NO SACRIFICE BAGS INC., King (CA)

( * ) Notice: Subject to any disclaimer, the term of this patent is extended or adjusted under 35 U.S.C. 154(b) by 212 days.

(21) Appl. No.: 17/551,270

(22) Filed: Dec. 15, 2021

(51) Int. Cl.

| | |
|---|---|
| ***A47G 29/08*** | (2006.01) |
| ***A45C 3/06*** | (2006.01) |
| ***A45C 13/00*** | (2006.01) |
| ***A45C 13/02*** | (2006.01) |
| ***A45C 13/10*** | (2006.01) |

(52) U.S. Cl.
CPC ..... *A47G 29/08* (2013.01); *A45C 3/06* (2013.01); *A45C 13/001* (2013.01); *A45C 13/02* (2013.01); *A45C 13/1069* (2013.01); *A45C 2200/15* (2013.01)

(58) Field of Classification Search
CPC ..... A47G 29/08; A45C 3/06; A45C 13/001; A45C 13/02; A45C 13/1069; A45C 2200/15
See application file for complete search history.

(56) References Cited

U.S. PATENT DOCUMENTS

| | | | | |
|---|---|---|---|---|
| 6,796,344 | B2 * | 9/2004 | Chen | A45C 3/06 150/113 |
| 9,199,580 | B2 | 12/2015 | Lehtonen | |
| 9,463,752 | B1 | 10/2016 | Lehtonen | |
| 10,588,390 | B1 * | 3/2020 | Pichardo | A45C 3/04 |
| 10,632,880 | B2 | 4/2020 | Lehtonen | |
| 10,731,789 | B1 * | 8/2020 | Dorsett | F16M 11/38 |
| D894,606 | S | 9/2020 | Lehtonen | |
| 10,869,569 | B2 | 12/2020 | Lehtonen | |
| 2004/0031702 | A1 | 2/2004 | Mangano | |
| 2006/0021684 | A1 * | 2/2006 | DeCoro, III | A45C 3/08 150/105 |

(Continued)

FOREIGN PATENT DOCUMENTS

| | | | |
|---|---|---|---|
| WO | 2011047364 | A1 | 4/2011 |

OTHER PUBLICATIONS

Roopini online blog post titled "Adding Hard Base, Bag feet and Magnetic Closure to a Bag" dated: Aug. 24, 2014, https://letsmakeitlovely.blogspot.com/2014/08/adding-hard-base-bag-feet-and-magnetic.html (Year: 2014).*

(Continued)

*Primary Examiner* — Terrell L Mckinnon
*Assistant Examiner* — Ding Y Tan
(74) *Attorney, Agent, or Firm* — Kintner IP, LLC; Mary Frances Ludwig

(57) ABSTRACT

A support for a purse supports a purse on a surface, such as a table, countertop, or floor, and prevents the purse from coming in contact with the surface. The support system includes multiple magnetically attachable elements, which may be rearranged in numerous different configurations as desired by the user. Elements of the support system include a base shaper, a purse support, a plurality of feet, and a purse organizer. In embodiments, the purse support is foldable and sized to be stored in the purse when not in use.

19 Claims, 20 Drawing Sheets

(56) References Cited

U.S. PATENT DOCUMENTS

| | | | | |
|---|---|---|---|---|
| 2008/0230158 | A1* | 9/2008 | Romero | A45C 1/02 150/105 |
| 2011/0073225 | A1* | 3/2011 | Pace | A45C 3/08 150/105 |
| 2014/0302287 | A1 | 10/2014 | Lehtonen | |
| 2016/0249717 | A1* | 9/2016 | Ocleppo | A45C 3/08 150/105 |
| 2017/0020249 | A1* | 1/2017 | Schroeder | A45C 13/02 |
| 2017/0021775 | A1* | 1/2017 | Spector | B60R 11/06 |
| 2018/0177270 | A1* | 6/2018 | Gordon | A45C 13/08 |
| 2018/0279727 | A1* | 10/2018 | Murphy | A45C 13/08 |
| 2018/0295959 | A1 | 10/2018 | Derryberry | |
| 2019/0110568 | A1* | 4/2019 | Cheers | A45C 13/002 |
| 2019/0350329 | A1* | 11/2019 | Parasca | A45C 3/06 |
| 2020/0170362 | A1* | 6/2020 | Xie | A45C 13/08 |
| 2022/0287423 | A1* | 9/2022 | Thomas | A45C 13/08 |

OTHER PUBLICATIONS

Chiceco hangbag base shaper sold on amazon first available date Dec. 23, 2019, https://www.amazon.com/CHICECO-Handbag-Shaper-Neverfull-Leather/dp/B08D1QNYZF (Year: 2019).*

Joan Hawley online article "Tutorial: Add Purse Feet to Your Next Bag Creation", https://www.lazygirldesigns.com/tutorial-add-purse-feet/ web.archive.org dated: Aug. 3, 2020 (Year: 2020).*

No Sacrifice Bags, "Bottomlines, " http://www.nosacrificebags.com/shop/bottomlines, 2021,pp. 1-5.

Amazon, "Stashio," https://www.amazon.com/stores/Stashio/page/E966B937-A1D2-41A9-A8D2-0FCB6D13CDD1?ref_=ast_bln, 2020, pp. 1-4.

Shenzen Wit Magnet Co., Limited, "Magnetic Push Pins", https://witmagnet.en.alibaba.com/productgrouplist-810396790/Magnetic_push_pins.html?spm=a2700.shop_index.35439.5.46ae2d8ccNJEQH, 1999, pp. 1-2.

Amazon, "Diymag Waterproof Neodymium Bar Magnets with Epoxy Coating, Permanent Earth Magnets, with Double-sided Adhesive," https://www.amazon.ca/gp/product/B07Z3YLTZZ/ref=ppx_yo_dt_b_search_asin_title?ie=UTF8&psc=1, 2019, pp. 1-10.

Amazon, "Senhai 8pcs Phone Car Mount Metal Plate with Adhesive for Magnetic Cradle-Less Mount, 4 Rectangular and 4 Round," https://www.amazon.ca/SENHAI-Adhesive-Magnetic-Cradle-Less-Rectangular/dp/B07KLPS1Z6/ref=pd_rhf_dp_s_pd_crcd, 2019, pp. 1-11.

* cited by examiner

SUPPORT FOR A PURSE

CROSS REFERENCE TO RELATED APPLICATION

None

TECHNICAL FIELD

The present invention pertains generally to purses and carrying bags, and more particularly to devices and systems for supporting a purse.

BACKGROUND OF THE INVENTION

Users of purses occasionally desire to rest their purse upon a surface, such as a table, countertop, or floor. Such surfaces may be dirty, especially in public settings. A user may therefore wish to support their purse in a manner that prevents contact with the surface.

In addition, purses may be considered fashion pieces, which an owner may wish to display.

BRIEF SUMMARY OF THE EMBODIMENTS

Embodiments disclosed herein are directed to a support for a purse with which a user may support a purse on a surface, such as a table, countertop, or floor, and which prevents the purse from coming in contact with the surface. The support system includes multiple magnetically attachable elements, which may be rearranged in numerous different configurations as desired by the user. The support system may include a base shaper, a purse support, a plurality of feet, and a purse organizer. In embodiments, the purse support is foldable and sized to be stored in the purse when not in use.

According to one or more embodiments of a support system for supporting a purse in standoff relation to a surface, where the purse has a base including an interior base surface and an exterior base surface, the support system includes:

- a base shaper configured for insertion into the purse and placement in contact with the interior base surface, wherein the base shaper is substantially planar and sized to substantially cover the interior base surface, and wherein the base shaper includes at least one of a magnet and a ferromagnetic material;
- a plurality of feet, wherein each of the feet has a top face configured for magnetic attachment to the base shaper with the base of the purse located between the base shaper and the plurality of feet, and wherein each of the feet has a bottom face configured to contact the surface, whereby the purse is positionable in standoff relation to the surface.

According to one or more embodiments, the support system includes a purse support configured for placement in contact with the exterior base surface of the purse and further configured for magnetic attachment to the base shaper and to the plurality of feet.

According to one or more embodiments of the support system, the purse support a thin substantially planar member.

According to one or more embodiments of the support system, the purse support is positionable into a folded position and an unfolded position.

According to one or more embodiments of the support system, the purse support includes a retainer configured to maintain the purse support in the folded position.

According to one or more embodiments of the support system, the purse support is shaped and dimensioned for concealment within the purse in the folded position.

According to one or more embodiments of the support system, the base shaper includes a plurality of distinct magnetically attractive regions.

According to one or more embodiments of the support system, the base shaper includes at least one magnetically attractive region proximate each of a first end and a second end of the base shaper.

According to one or more embodiments of the support system, the base shaper includes at least one magnetically attractive region substantially centrally located between a first end and a second end of the base shaper.

According to one or more embodiments of the support system, the base shaper includes from three to five magnetically attractive regions.

According to one or more embodiments of the support system, the plurality of feet includes from four to six feet.

According to one or more embodiments, the support system includes a purse organizer sized and dimensioned for concealment within the purse, wherein the purse organizer is configured for magnetic attachment to the base shaper.

According to one or more embodiments of the support system, the purse organizer includes at least two distinct magnetically attractive regions.

According to one or more embodiments of the support system, each of the plurality of feet has a magnet proximate the top face.

According to one or more embodiments of the support system, the base shaper has a plurality of distinct magnetically attractive regions, and each of the magnetically attractive regions includes a ferromagnetic material.

According to one or more embodiments of a support system for supporting a purse in standoff relation to a surface, where the purse has a base including an interior base surface and an exterior base surface, the support system includes:

- a base shaper configured for insertion into the purse and placement in contact with the interior base surface, wherein the base shaper is substantially planar and sized to substantially cover the interior base surface, and wherein the base shaper includes at least one of a magnet and a ferromagnetic material;
- a purse support configured for placement in contact with the exterior base surface of the purse and further configured for magnetic attachment to the base shaper with the base of the purse located between the base shaper and the purse support; and
- a plurality of feet, wherein each of the feet has a top face configured for magnetic attachment to the purse support and a bottom face configured to contact the surface, whereby the purse is positionable in standoff relation to the surface.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the support for a purse are described with reference to the following figures, wherein like reference numerals refer to like parts throughout the various views unless otherwise specified.

Figure 1:
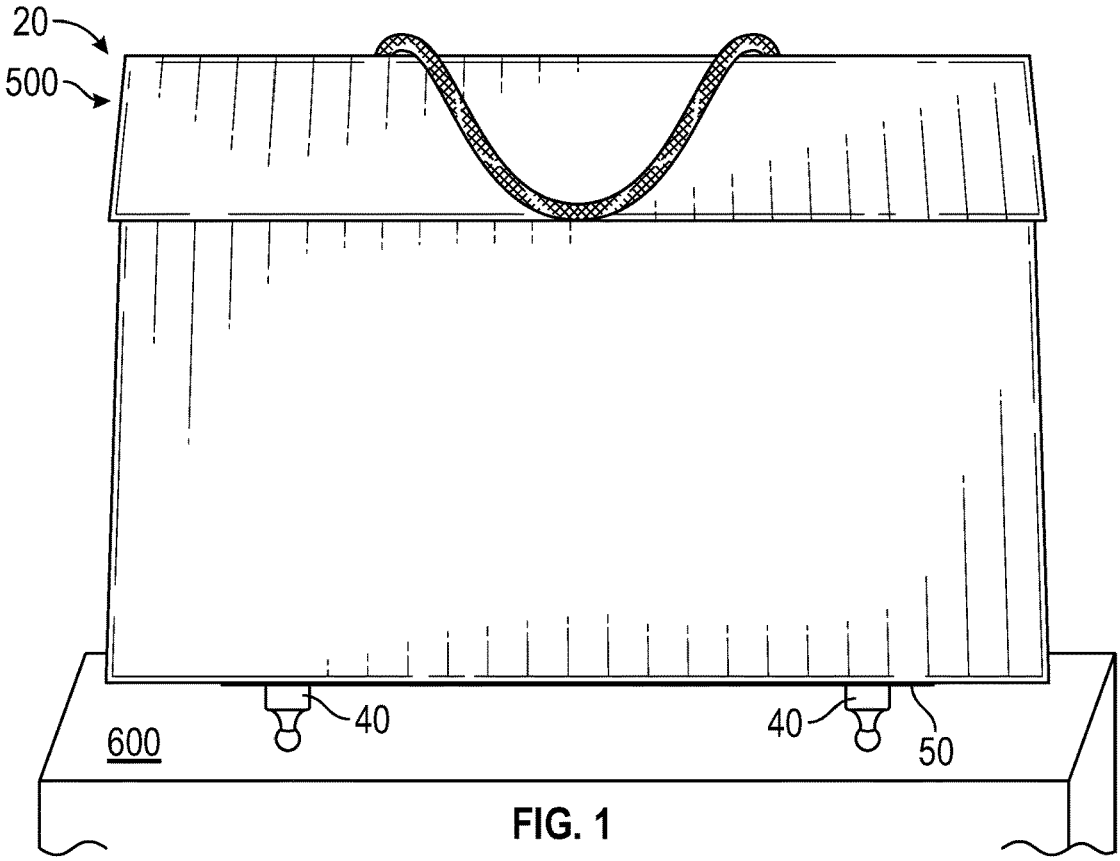
FIG. 1 is a front elevation view of an embodiment of a support system for a purse.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

LIST OF DRAWING REFERENCE NUMERALS

20 support system
30 base shaper
32 magnetically attractive region (of base shaper)
34 first end
36 second end
40 foot
42 top face
44 bottom face
50 purse support
52 magnetically attractive region (of purse support)
53 bottom face
54 first end
56 second end
57 first member
58 second member
59 corner
60 purse organizer
62 magnetically attractive region (of purse organizer)
64 pockets
65 bottom
66 handles
67 first fastener
68 second fastener
69 purse organizer sidewall
70 pouch
71 fastener
72 sleeve
73 open mouth
80 screw
82 nut
83 decoration
500 purse

510 base
512 interior base surface
514 exterior base surface
600 surface

DETAILED DESCRIPTION OF THE INVENTION

Figure 2:
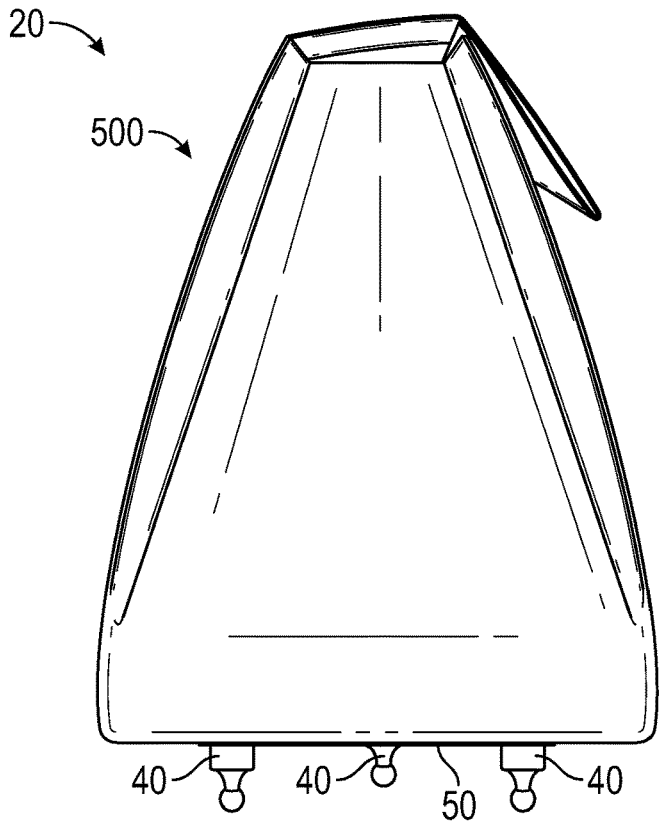
FIG. 2 is a side elevation view of an embodiment of the support system, the opposing side elevation view being a mirror image.

FIGS. 1 & 2 illustrate front and side elevation views, respectively, of a support system 20, used to support a purse 500. Support system 20 includes a purse support 50 which supports purse 500 in standoff relation to a surface 600. For example, purse support 50 may hold purse 500 offset from surface 600 such that no part of purse 500 is in contact with surface 600. Support system 20 further includes a plurality of feet 40 which are each magnetically attachable to purse support 50. In use, feet 40 are generally located below purse support 50 and in contact with surface 600, thereby positioning purse 500 in standoff relation to the surface.

As used herein, a "purse" refers generally to any type of carrying bag, such as a shoulder bag, a handbag, a crossbody bag, a clutch, a waistbag, a backpack, a travel bag, or a bag for small goods. Purse 500 has a base 510 which has two major surfaces: an interior base surface 512 which faces the interior of the purse, and an exterior base surface 514 which may also be referred to as the bottom of the purse.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, the term "shaped" means that an item has the overall appearance of a given shape even if there are minor variations from the pure form of said given shape.

As used herein, the terms "generally" or "substantially" when referring to a shape mean that an ordinary observer will perceive that an object has said shape even if there are minor variations from said shape.

As used herein, relative orientation terms, such as "up", "down", "top", "bottom", "left", "right", "vertical", "horizontal", "distal" and "proximal" are defined with respect to an initial presentation of an object and will continue to refer to the same portion of an object even if the object is subsequently presented with an alternative orientation, unless otherwise noted.

Figure 3A:
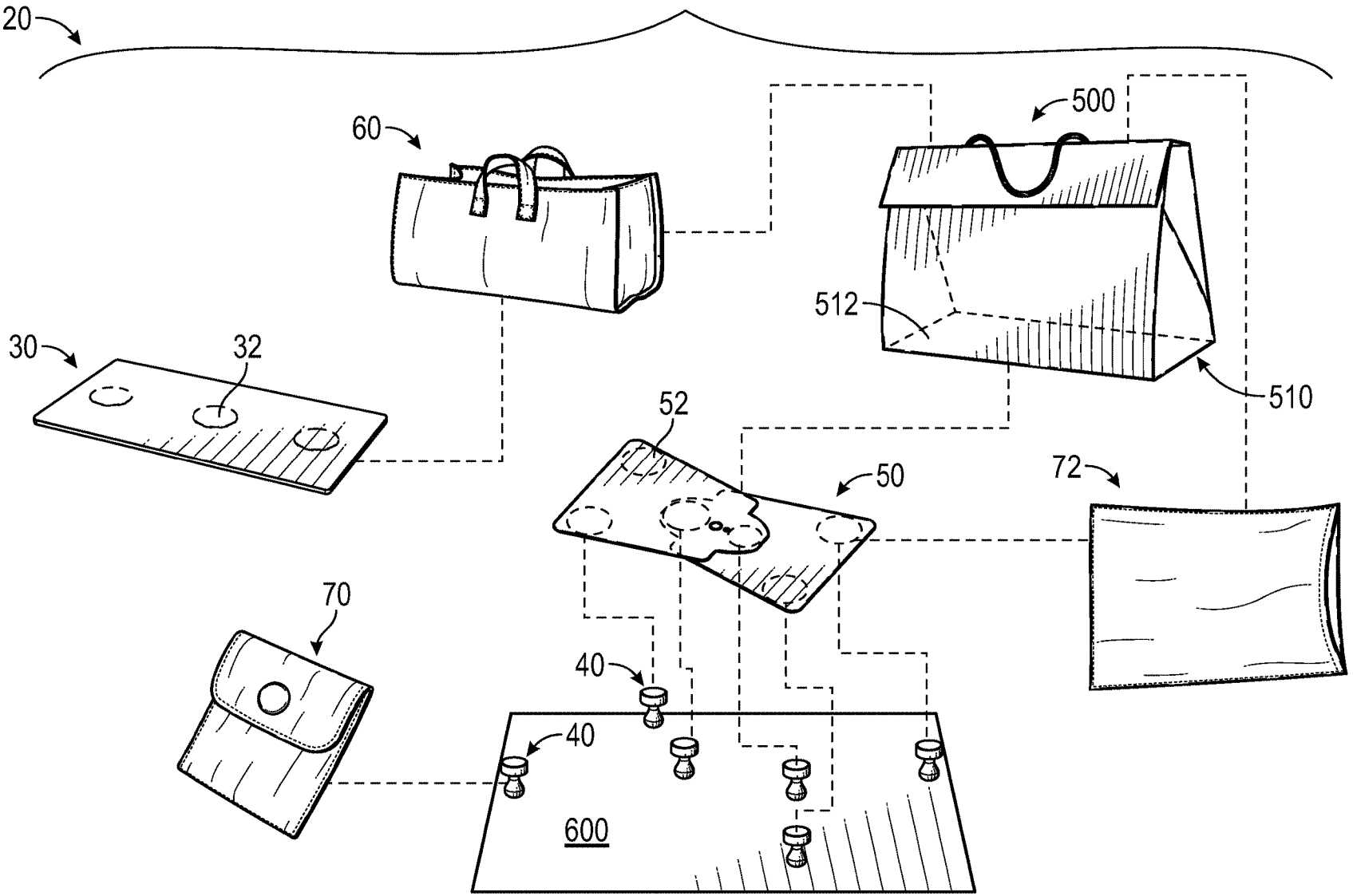
FIG. 3A is a reduced scale exploded perspective view of an embodiment of the support system.
Figure 3B:
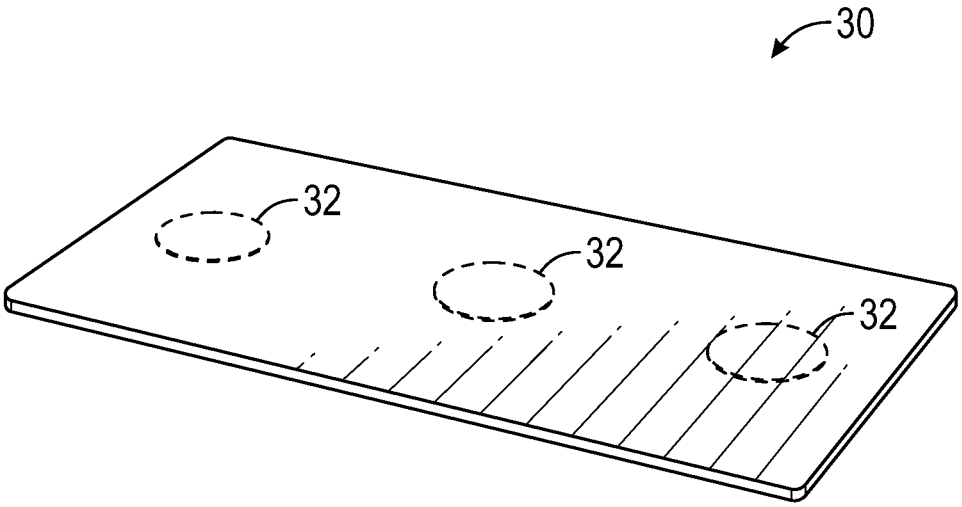
FIG. 3B is a full-scale perspective view of a base shaper of the FIG. 3A embodiment.
Figure 3C:
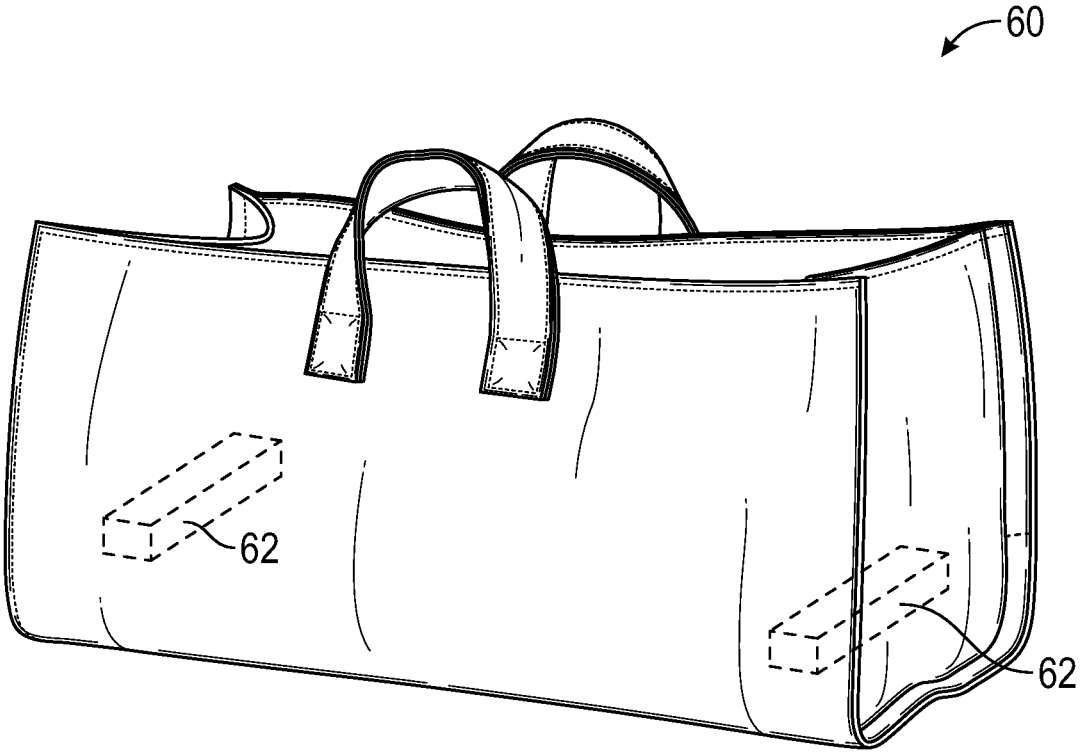
FIG. 3C is a full-scale perspective view of a purse organizer of the FIG. 3A embodiment.
Figure 3D:
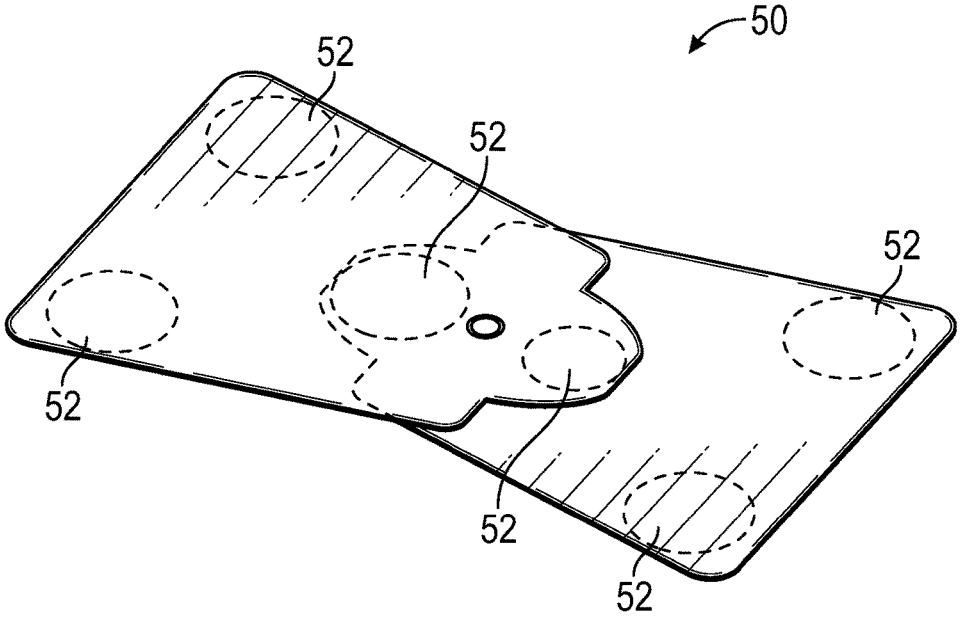
FIG. 3D is a full-scale perspective view of a purse support of the FIG. 3A embodiment.
Figure 3E:
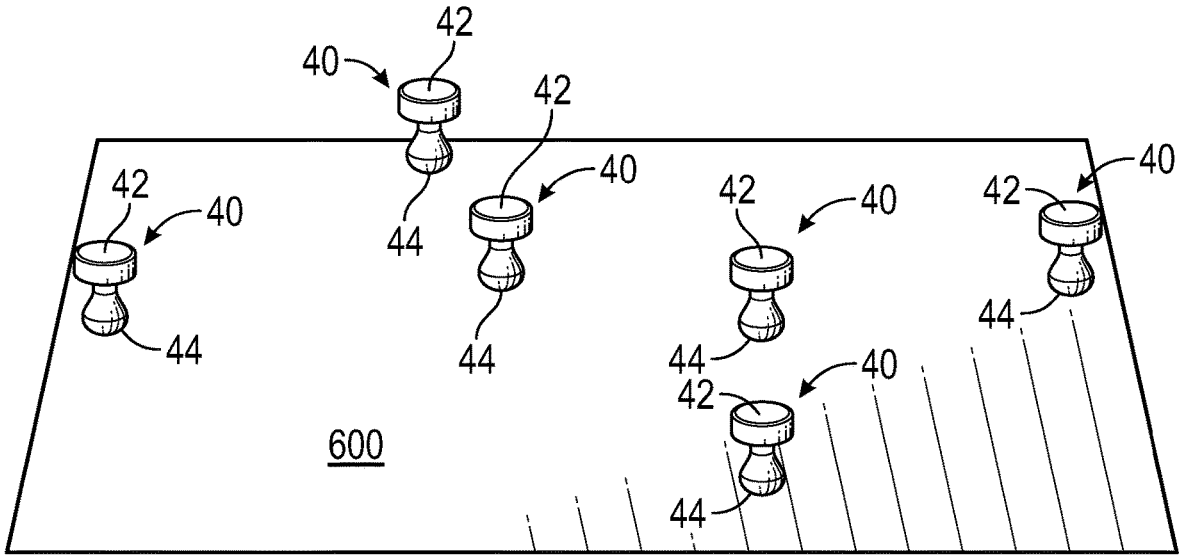
FIG. 3E is a full-scale perspective view of a plurality of feet of the FIG. 3A embodiment.

FIG. 3A is a reduced scale exploded perspective view of an embodiment of support system 20. FIGS. 3B-3G are full-scale perspective views, respectively, of components of the support system of FIG. 3A, specifically, a base shaper 30, a purse organizer 60, purse support 50, feet 40 (six shown), a pouch 70, and a sleeve 72.

Figure 23:
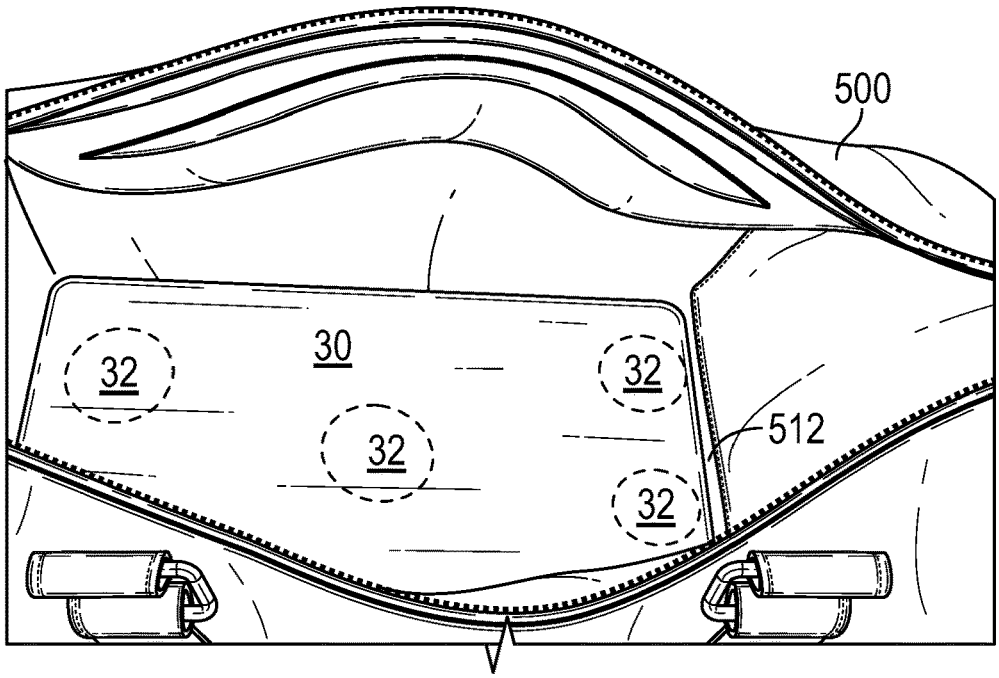
FIG. 23 is an enlarged partial top plan view of the FIG. 22 embodiment.

Base shaper 30 (see FIG. 3B) is a substantially planar member configured to be inserted into purse 500 and placed in contact with interior base surface 512 of the purse (see also FIG. 23). The base shaper is sized to substantially cover interior base surface 512. In this way, the base shaper imparts stiffness to the structure of base 510 of the purse, which might otherwise be quite flexible, especially in purses made of leather, textiles, or other pliable materials. Base shaper 30 includes one or more magnetically attractive regions 32 (three shown in hidden lines in FIG. 3A). Magnetically attractive regions 32 may include one or more magnets or may be made of a ferromagnetic material. Magnetically attractive regions 32 may magnetically attach, or couple, to other elements of support system 20. Magnetically attractive regions 32 may magnetically attach to elements located inside of purse 500 or external to purse 500.

Purse organizer 60 (see FIG. 3C) is configured to be concealed within purse 500. For example, purse organizer 60 may have a size, shape, or dimension which allows the purse to be closed with the purse organizer inside of the purse. Purse organizer 60 is configured to be magnetically attached to base shaper 30. Purse organizer 60 may have one or more magnetically attractive regions 62, such as a magnet or a ferromagnetic material, which may be attracted to corresponding magnetically attractive regions 32 of base shaper 30. In addition, or instead, magnetically attractive regions 62 may couple magnetically to other elements of support system 20 which may be located inside of or external to purse 500.

Purse support 50 (see FIG. 3D) is configured to be placed in contact with exterior base surface 514 of purse 500, in other words, purse 500 may rest upon purse support 50. Purse support 50 may be a thin, substantially planar member, and may be made of a rigid or semi-rigid material, such as plastic, metal, or cork. In the shown embodiment, purse support 50 includes six distinct magnetically attractive regions 52, which may be magnetically attachable to corresponding magnetically attractive regions 32 of base shaper 30. In addition, or instead, magnetically attractive regions 52 may be magnetically attachable to one or more feet 40. For example, in the shown embodiment, base shaper 30 is placed in purse 500 so that the base shaper is generally in contact with base 510 of the purse. Purse support 50 is placed beneath purse 500 and magnetically attached to base shaper 30 through base 510 of the purse (i.e., base 510 of purse 500 is positioned between base shaper 30 inside the purse and purse support 50 outside of the purse). Six feet 40 are attached to the distinct magnetically attractive regions 52 of purse support 50 (one foot attached to each magnetically attractive region). In specific embodiments, purse support 50 may be formed of a tinplated ferromagnetic metal, or may be formed of an opaque plastic layer with adhesive backed magnets adhered thereto.

Each foot 40 (see FIG. 3E) has a top face 42 which may be magnetically attached to another element of support system 20, such as purse support 50 as in the shown embodiment. In some cases, foot 40 may include a magnet located proximate top face 42. In other cases, top face 42 may include a ferromagnetic material. Each foot 40 also has a bottom face 44, located opposite top face 42. In use, bottom face 44 of each foot 40 contacts surface 600, and provides separation between purse support 50 and surface 600. As purse support 50 and surface 600 are separated by a standoff distance equal to the height of feet 40, it may be desirable to have feet of varying shapes and sizes.

Figure 3F:
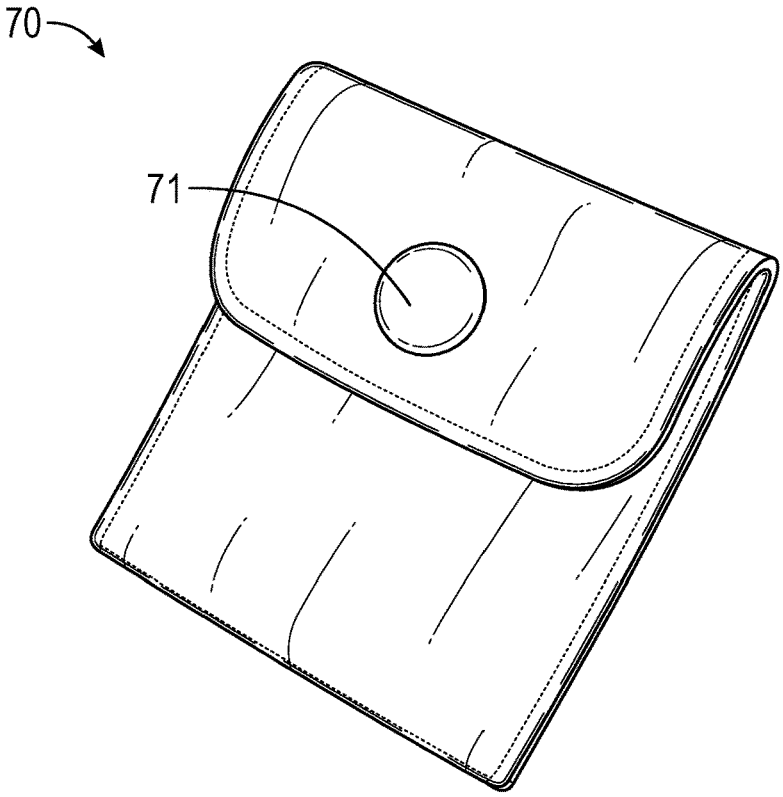
FIG. 3F is a full-scale perspective view of a pouch of the FIG. 3A embodiment.
Figure 3G:
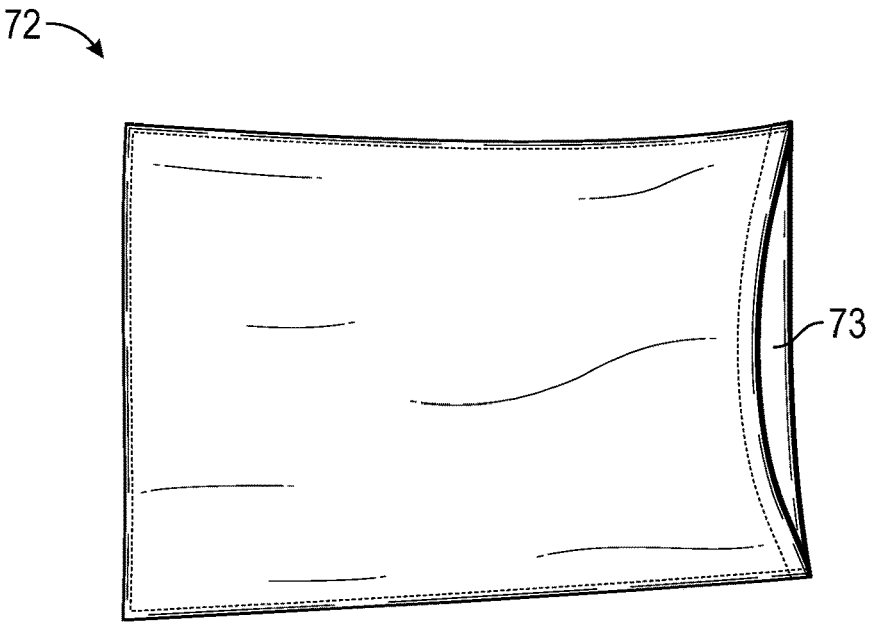
FIG. 3G is a full-scale perspective view of a sleeve of the FIG. 3A embodiment.

A pouch 70, useful for holding feet 40 when not in use, may be included in some embodiments (see FIG. 3F). Pouch 70 may be formed of fabric, plastic, or similar lightweight yet durable materials. Pouch 70 may be sized for storage within purse 500. The material of pouch 70 may be sufficiently thin that feet 40 are magnetically attachable to other elements of the system when contained within the pouch. For example, pouch 70 containing feet 40 may magnetically attach to purse support 50. This feature may simplify storage of system components and keep feet 40 readily accessible within the purse. The shown pouch 70 includes a fastener 71, such as a snap or button. Including a fastener may be preferred to prevent feet 40 from falling out of the pouch. A fastener may not be provided in other embodiments.

A sleeve 72 (see FIG. 3G) may be provided in some embodiments. Sleeve 72 may be sized to hold purse support 50 and/or other system components, such as feet 40. Sleeve 72 may be formed of fabric, plastic, or similar lightweight yet durable materials. Sleeve 72 may be desired for organizational purposes, or to keep purse support 50 separate from other items contained in the purse, as purse support 50 may become soiled with use. In the shown embodiment, sleeve 72 has an open mouth 73 through which system components may be inserted. In other embodiments, sleeve 72 may include a fastener, such as a zipper or snap.

Figure 4:
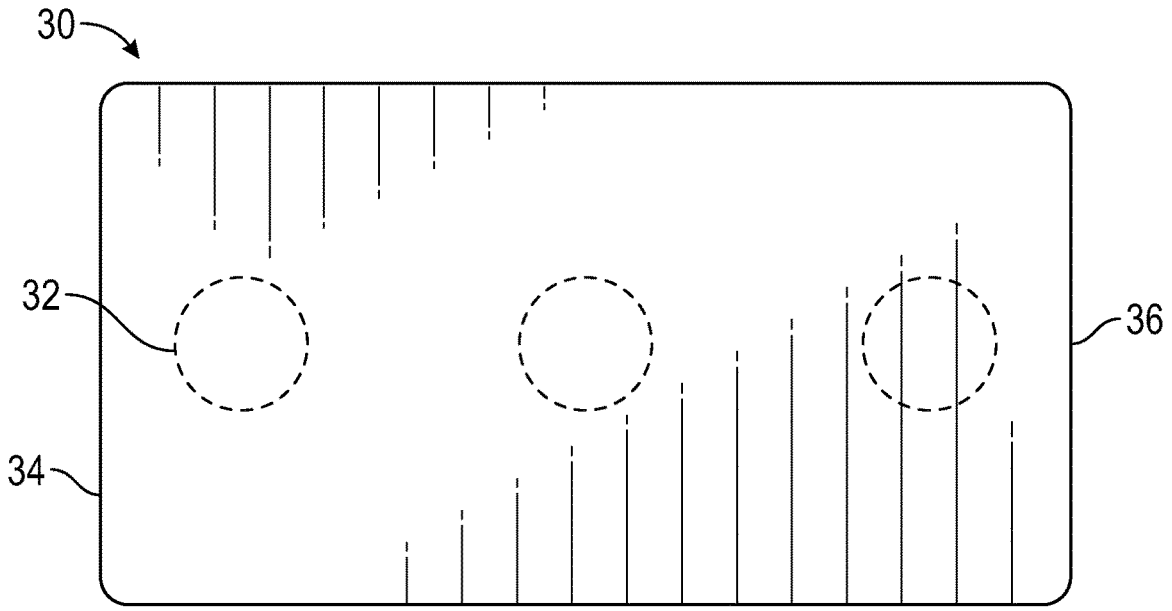
FIG. 4 is a top plan view of an embodiment of the base shaper.
Figure 5:
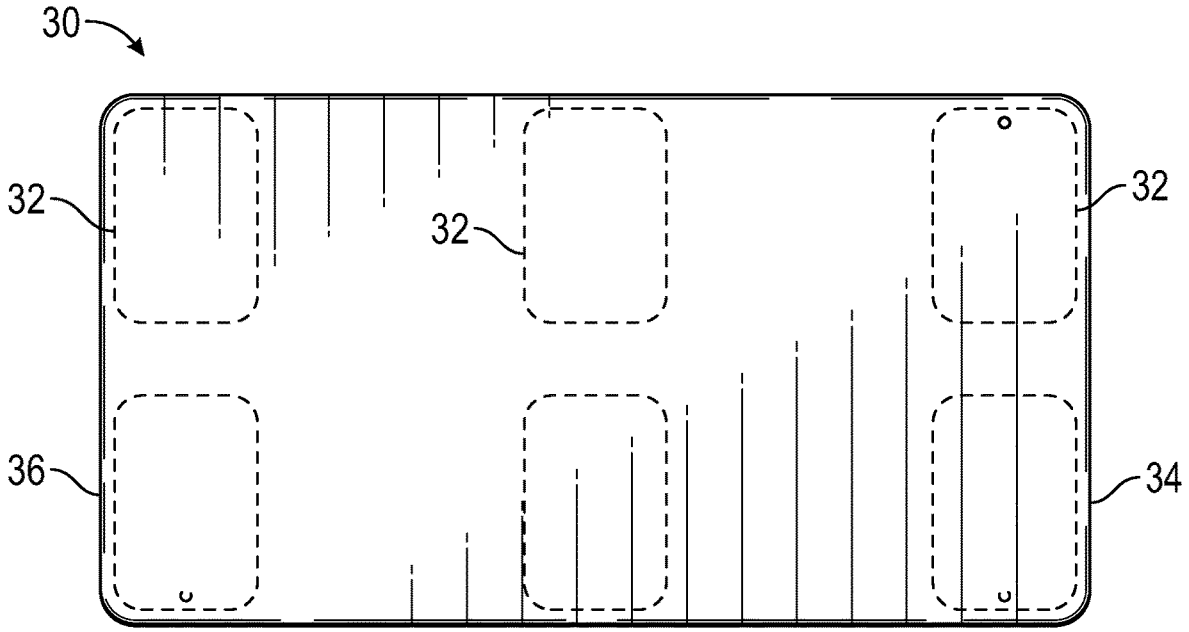
FIG. 5 is a bottom plan view of an embodiment of the base shaper.
Figure 6:
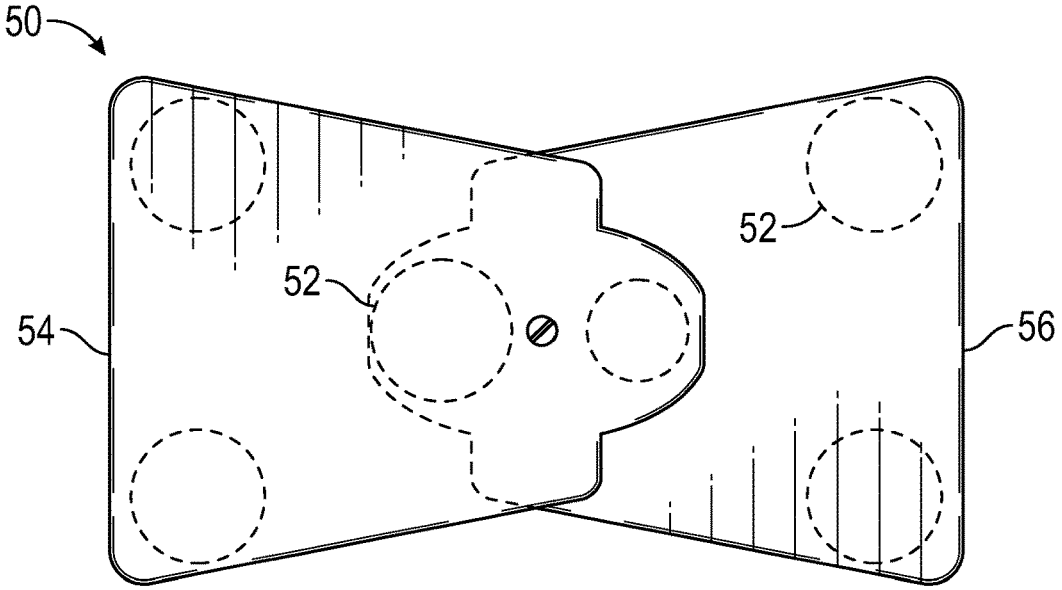
FIG. 6 is a top plan view of an embodiment of the purse support.
Figure 7:
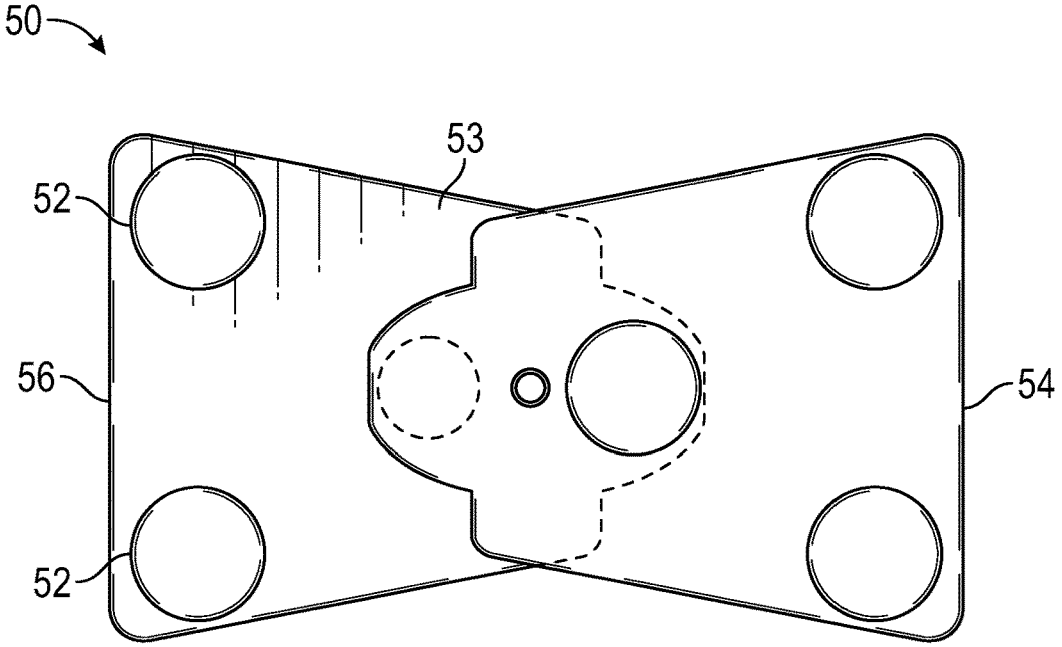
FIG. 7 is a bottom plan view of an embodiment of the purse support.
Figure 8:
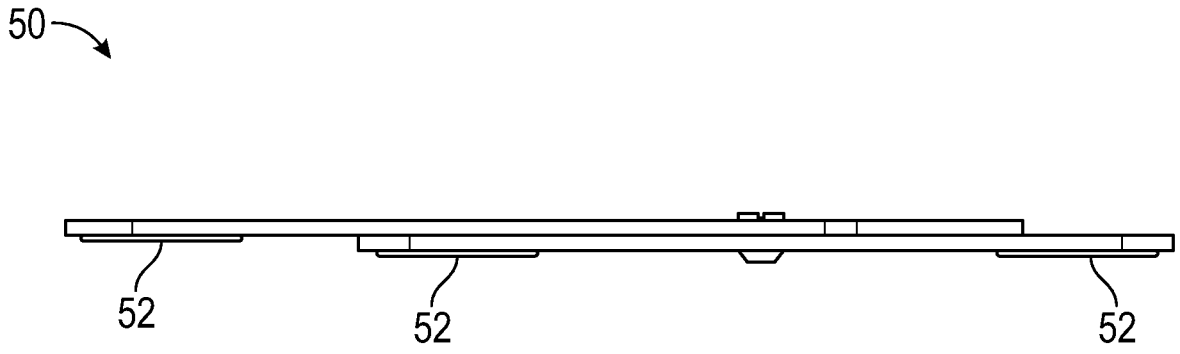
FIG. 8 is an enlarged first side elevation view of an embodiment of the purse support.
Figure 9:
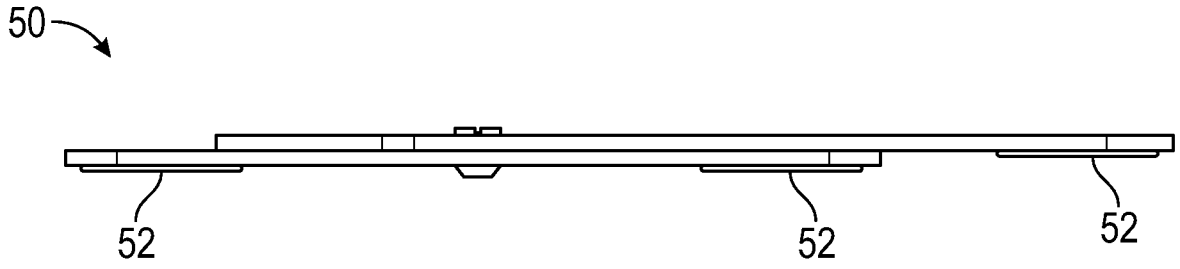
FIG. 9 is an enlarged second side elevation view of an embodiment of the purse support.

FIGS. 4 & 5 are top and bottom plan views, respectively, of embodiments of base shaper 30. Each embodiment shown includes multiple distinct magnetically attractive regions 32 (three shown in FIG. 4 and six shown in FIG. 5). In the embodiments shown, magnetically attractive regions 32 are shown in dashed lines, indicating that these features may be hidden, or located internally to base shaper 30. For example, base shaper 30 may have a central layer, e.g., a cork layer, magnetically attractive regions 32 may be connected to both the top and bottom faces of the central layer, and the central layer and magnetically attractive regions may all be wrapped in a fabric outer layer. In other embodiments, magnetically attractive regions 32 may be visible, for example, magnetically attractive regions 32 may be directly affixed to the exterior top and bottom faces of the base shaper.

In the shown examples, base shaper 30 includes at least one magnetically attractive region 32 located near each of a first end 34 and a second end 36 of base shaper 30. These magnetically attractive regions 32 may connect to feet positioned near the ends of the purse, providing stability for the system. In addition, at least one magnetically attractive region 32 is substantially centrally located between first end 34 and second end 36 of base shaper 30 (for example, approximately in the middle of the top or bottom face of the base shaper). This magnetically attractive region may provide additional stability in the middle of the system, to counteract any tendency for the system to sag when used with a large or heavy purse. In some embodiments, base shaper 30 may include three, four, five, or six magnetically attractive regions. In other embodiments, magnetically attractive regions 32 may be larger than those shown here. For example, a magnetically attractive region may extend substantially along the entire length of one dimension of the base shaper. In other embodiments, the base shaper may include a large layer of a ferromagnetic material, e.g. sized and shaped substantially the same or slightly smaller than the base shaper. This embodiment would provide one large magnetically attractive region.

FIGS. 6-9 are top and bottom plan, and first and second side elevation views, respectively, of an embodiment of purse support 50. In the shown embodiment, purse support 50 includes five distinct magnetically attractive regions 52. In an example configuration, magnetically attractive regions 52 may be thin adhesive backed pieces of ferromagnetic material attached to a bottom face 53 of purse support 50. In another configuration, magnetically attractive regions 52 may be magnets rather than ferromagnetic material. Magnetically attractive regions 52 of purse support 50 may be configured in a similar number and location as described above regarding magnetically attractive region 32 of base shaper 30. One or more magnetically attractive regions 52 may be located near each of a first end 54, a second end 56, and a central location of the purse support 50. In yet another configuration, purse support 50 may include a large layer of a ferromagnetic material, e.g. sized and shaped substantially the same or slightly smaller than the entire purse support. This embodiment would provide one large magnetically attractive region.

Figure 10:
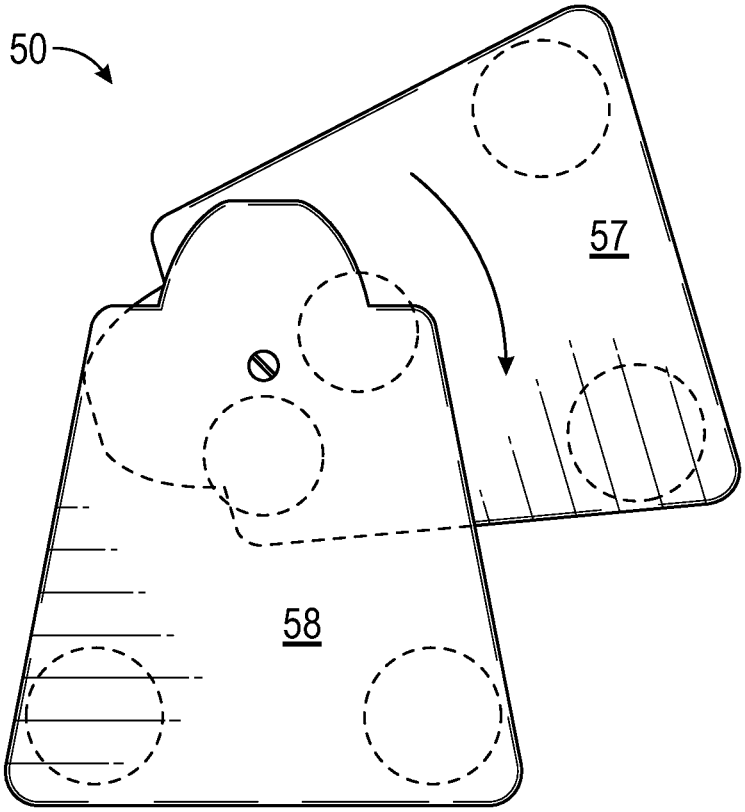
FIG. 10 is a top plan view of an embodiment of the purse support being positioned between an unfolded position and a folded position.
Figure 11:
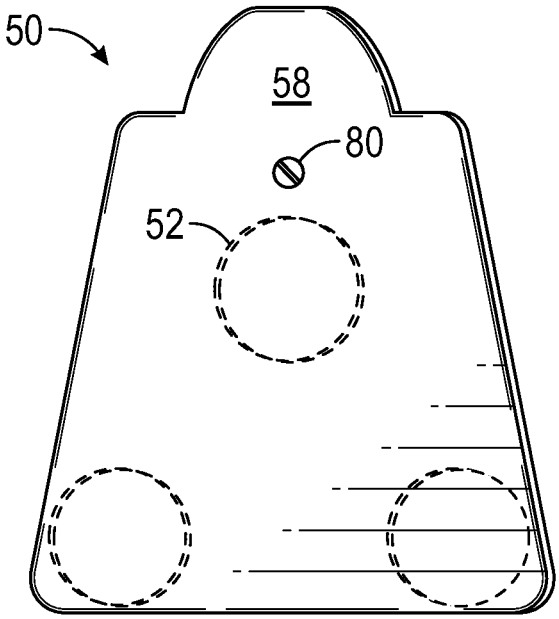
FIG. 11 is a top plan view of an embodiment of the purse support, in a folded position.
Figure 12:
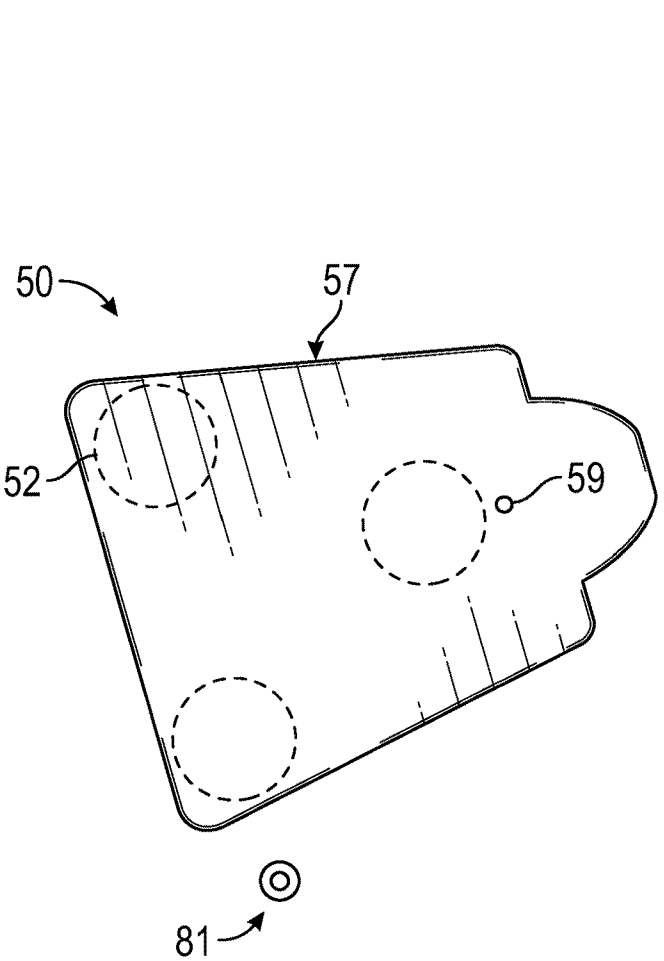
FIG. 12 is a side elevation view of an embodiment of the purse support, in a folded position.
Figure 12:
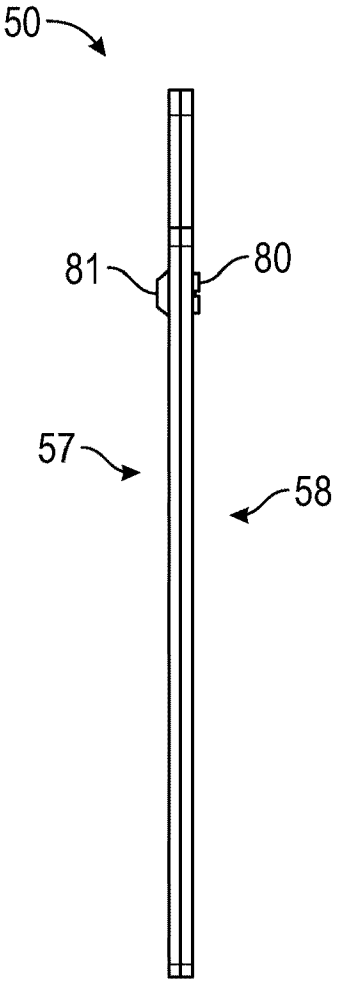

FIG. 10 is a top plan view of an embodiment of the purse support being positioned between an unfolded position and a folded position. Purse support 50 is positionable between the folded position and the unfolded position by pivoting a portion of the purse support as indicated by the directional arrow. FIGS. 11 & 12 illustrate top plan and side elevation views, respectively, of an embodiment of purse support 50 in the folded position. In the folded position of this embodiment, purse support 50 has a thin, substantially flat shape, just as it does in the unfolded position. In the folded position, this embodiment of the purse support has a purse-shaped outline (see. FIG. 11).

Figure 13:
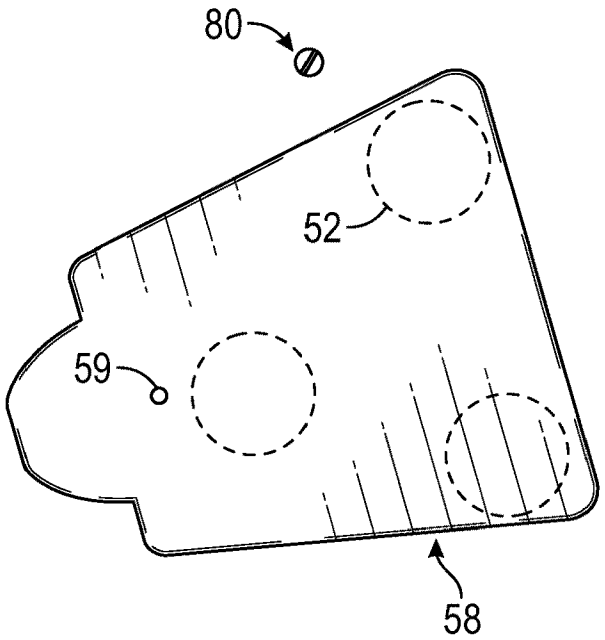
FIG. 13 is a reduced scale exploded perspective view of an embodiment of the purse support.

FIG. 13 is an exploded perspective view of an embodiment of purse support 50. In the shown embodiment, purse support 50 includes a first member 57 and a second member 58 which have substantially the same size and shape as one another. First member 57 and second member 58 are connected by a retainer, such as a screw 80 and a nut 81. When purse support 50 is positioned in the folded position, first member 57 and second member 58 may be pivoted about the retainer to lie on top of one another (see also FIGS. 10-12). Screw 80 may be, for example, a low profile thumbscrew or flat-head screw. Screw 80 may be inserted into through holes 59 in each of the first and second members, and nut 82 may be affixed to the screw. Other types of retainer having an equivalent function may be readily envisioned by a skilled artisan. Purse support 50 may be positionable between folded and unfolded positioned when the screw and nut are loosely engaged. By tightly engaging the screw and nut, purse support 50 may be retained in either the folded position or the unfolded position. Purse support may alternatively be configured to fold in other ways. For example, the purse support may fold in an accordion configuration, or along predetermined fold lines.

Purse support 50 may be shaped and dimensioned so that it may be stored and fully concealed within purse 500 when purse support 50 is in the folded position. As discussed with reference to FIG. 3A, purse support 50 may be stored within sleeve 72. In addition, or instead, purse support 50 may be shaped and dimensioned so that it may be stored and fully concealed within purse 500 when purse support 50 is in the unfolded position.

Figure 14:
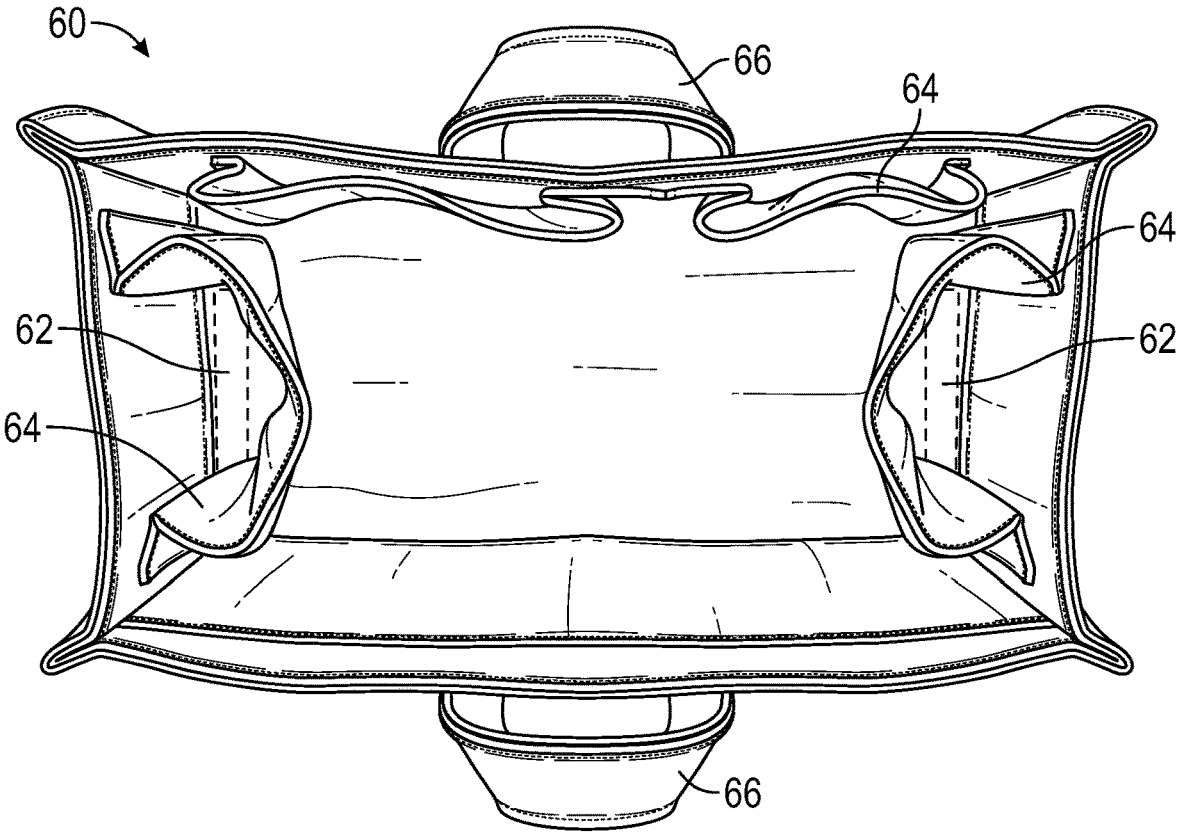
FIG. 14 is a top plan view of an embodiment of the purse organizer.

FIG. 14 is a top plan view of an embodiment of purse organizer 60. Purse organizer 60 may include pockets 64 for storing small items, and may also or instead include handles 66. In embodiments, purse organizer 60 includes at least two distinct magnetically attractive regions 62. In the shown embodiment, two pockets 64 each have one magnet 62 located in the bottom of the pocket. These magnetically attractive regions 62 may couple magnetically to other elements of support system 20 which may be located inside of or external to purse 500. In other embodiments, magnetically attractive regions 62 may be sewn between layers of the purse organizer, or may be located on the outside of purse organizer 60.

Figure 15:
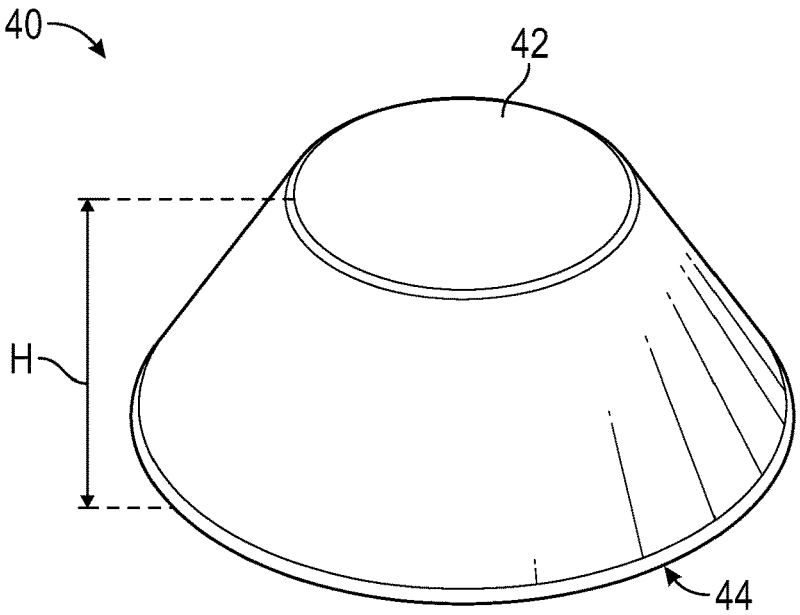
FIG. 15 is an enlarged perspective view of an embodiment of a foot.

FIG. 15 is an enlarged perspective view of another embodiment of a foot 40, having a frustoconical shape. Foot 40 has a top face 42 which may be magnetically attached to another element of support system 20. Foot 40 also has a bottom face 44, located opposite top face 42, which contacts a surface when in use. Feet 40 may have a variety of sizes and shapes, for example cuboid, rectangular cuboid, frustopyramidal, a spherical segment, etc. The height, H, of foot 40 is the distance between top face 42 and bottom face 44. Height 'H' controls the separation, or standoff, distance between the purse and the surface. Feet having a larger height may be preferred for systems designed to support large or heavy purses. In other cases, the height of the feet may be selected based upon style preference.

Figure 16:
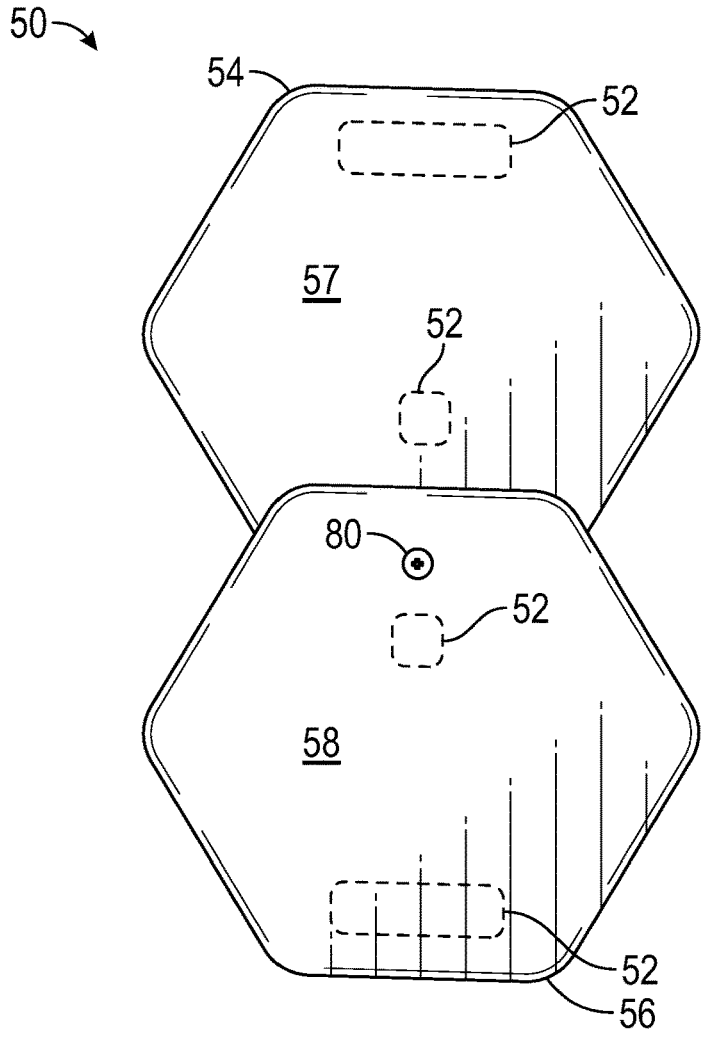
FIG. 16 is a top plan view of another embodiment of the purse support, in an unfolded position.
Figure 17:
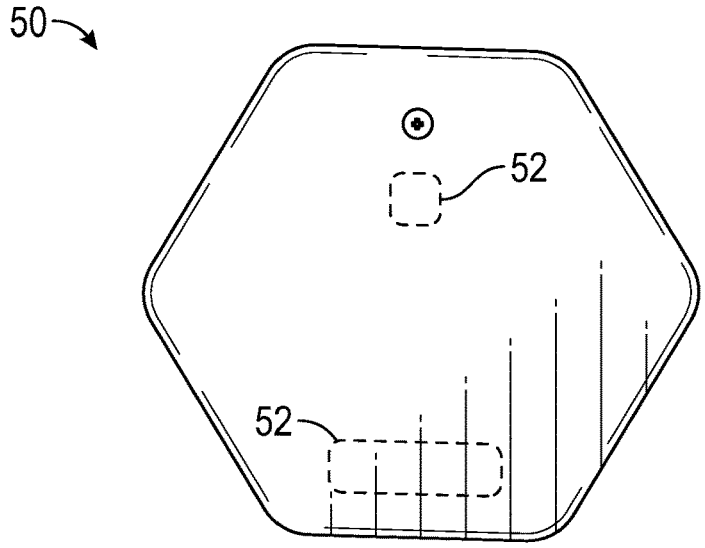
FIG. 17 is a top plan view of the embodiment of FIG. 16, in a folded position.

FIGS. 16 & 17 are top plan views of another embodiment of purse support 50, in unfolded position and folded positions, respectively. Purse support 50 is positionable between the folded position and the unfolded position by pivoting one or both of first member 57 and second member 58 about a retainer (e.g. screw 80) in the manner generally described with reference to FIGS. 10-13. In the folded position, the shown embodiment of purse support 50 has a substantially hexagonal shape. In the shown embodiment, purse support 50 includes four distinct magnetically attractive regions 52, which may be magnetically attachable to other components of support system 20. Magnetically attractive regions 52 may be sized and shaped differently from one another, for example, and as shown, some magnetically attractive regions 52 may be generally rectangular while others may be generally square. In the shown arrangement, one magnetically attractive region 52 is located near each of first end 54 and second end 56, while two magnetically attractive regions 52 are located near the center of purse support 50.

Figure 18:
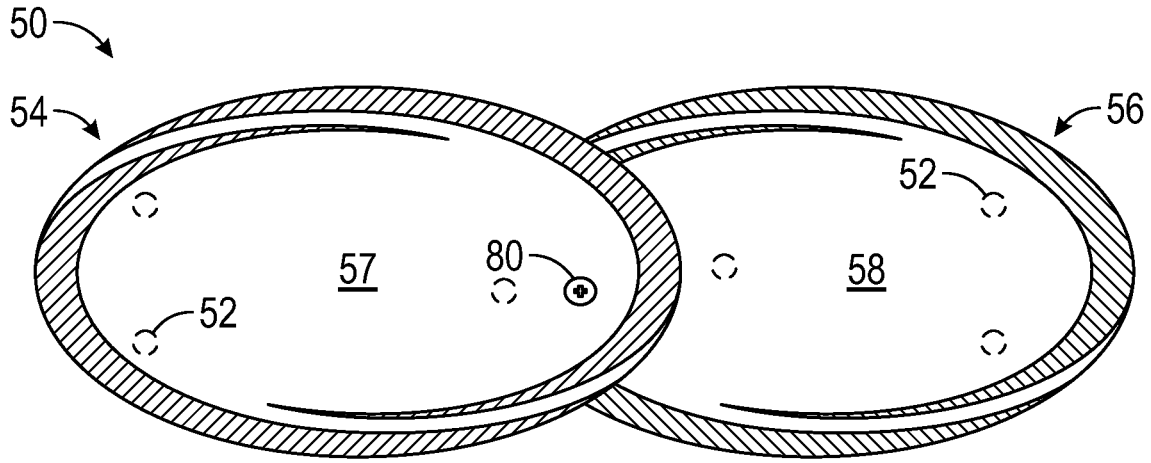
FIG. 18 is a top plan view of another embodiment of the purse support, in an unfolded position.
Figure 19:
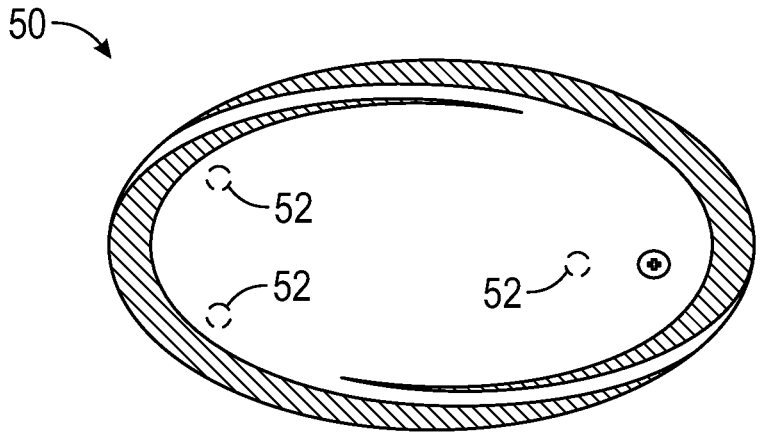
FIG. 19 is a top plan view of the embodiment of FIG. 18, in a folded position.

FIGS. 18 & 19 are top plan views of another embodiment of purse support 50, in an unfolded position and a folded position, respectively. As described above, purse support 50 is positionable between the folded position and the unfolded position by pivoting one of first member 57 and second member 58 about a retainer (e.g., screw 80). In the folded position, the shown embodiment of the purse support has a substantially ovoid shape. In the shown embodiment, purse support 50 includes six distinct magnetically attractive regions 52, which are shaped as small circles and illustrated in hidden (dashed) lines. In the shown arrangement, two magnetically attractive regions 52 are located near each of first end 54 and second end 56, while two additional magnetically attractive regions 52 are located near the center of purse support 50.

Figure 20:
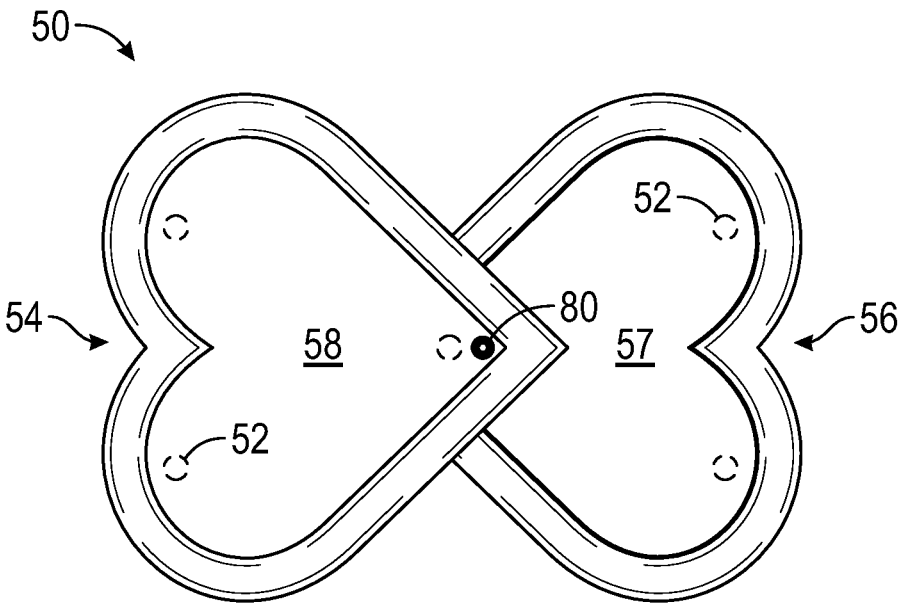
FIG. 20 is a top plan view of another embodiment of the purse support, in an unfolded position.
Figure 21:
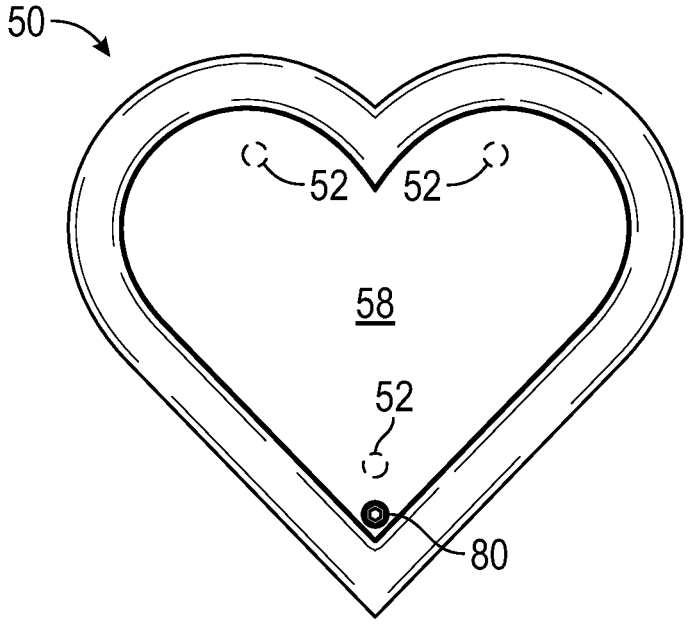
FIG. 21 is a top plan view of the embodiment of FIG. 20, in a folded position.

FIGS. 20 & 21 are top plan views of another embodiment of purse support 50, shown in an unfolded position and a folded position, respectively. As described above, purse support 50 is positionable between the folded position and the unfolded position by pivoting one of first member 57 and second member 58 about a retainer (e.g., screw 80). In the folded position, the shown embodiment of the purse support is generally heart-shaped. In the shown embodiment, purse support 50 includes five distinct magnetically attractive regions 52, which are shaped as small circles and illustrated in hidden (dashed) lines. In the shown arrangement, two magnetically attractive regions 52 are located near each of first end 54 and second end 56, while one additional magnetically attractive region 52 is located near the center of purse support 50, on second member 58.

Figure 22:
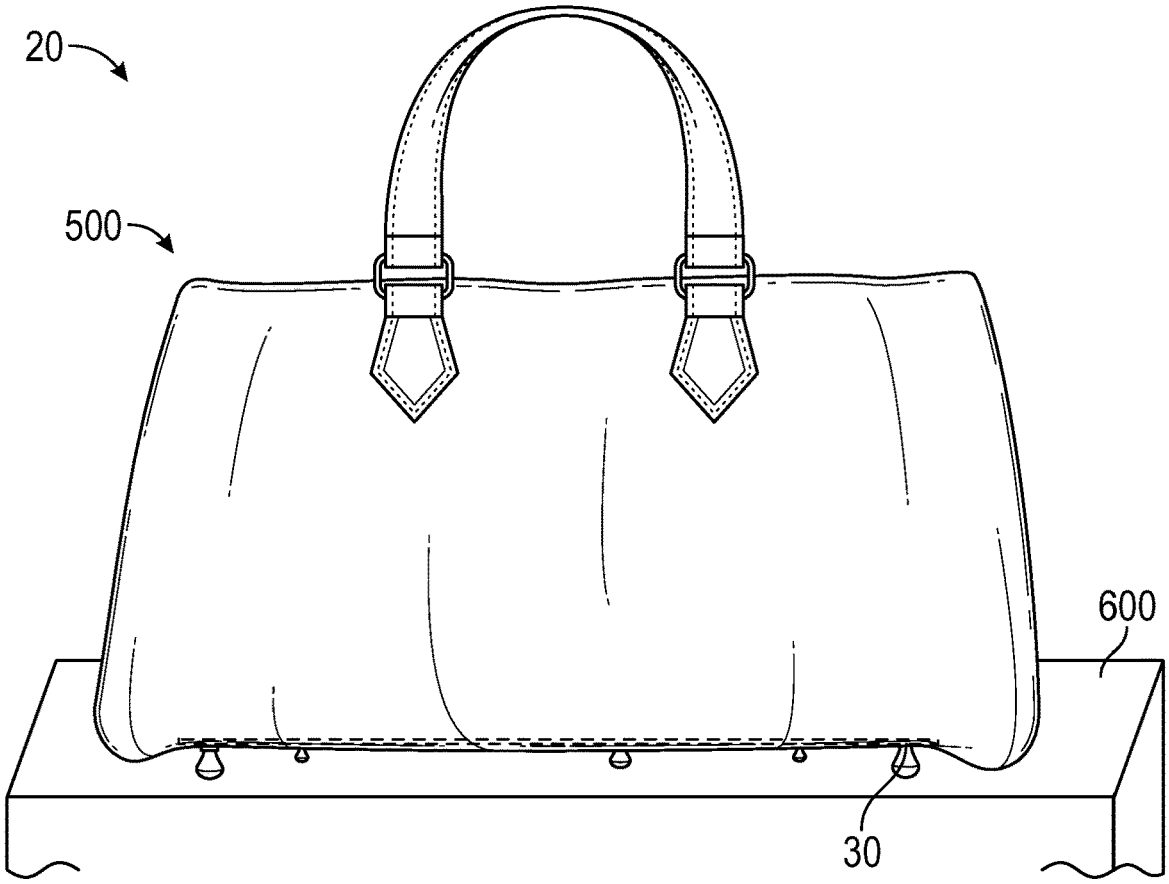
FIG. 22 is a front elevation view of another embodiment of the support system for a purse.
Figure 24:
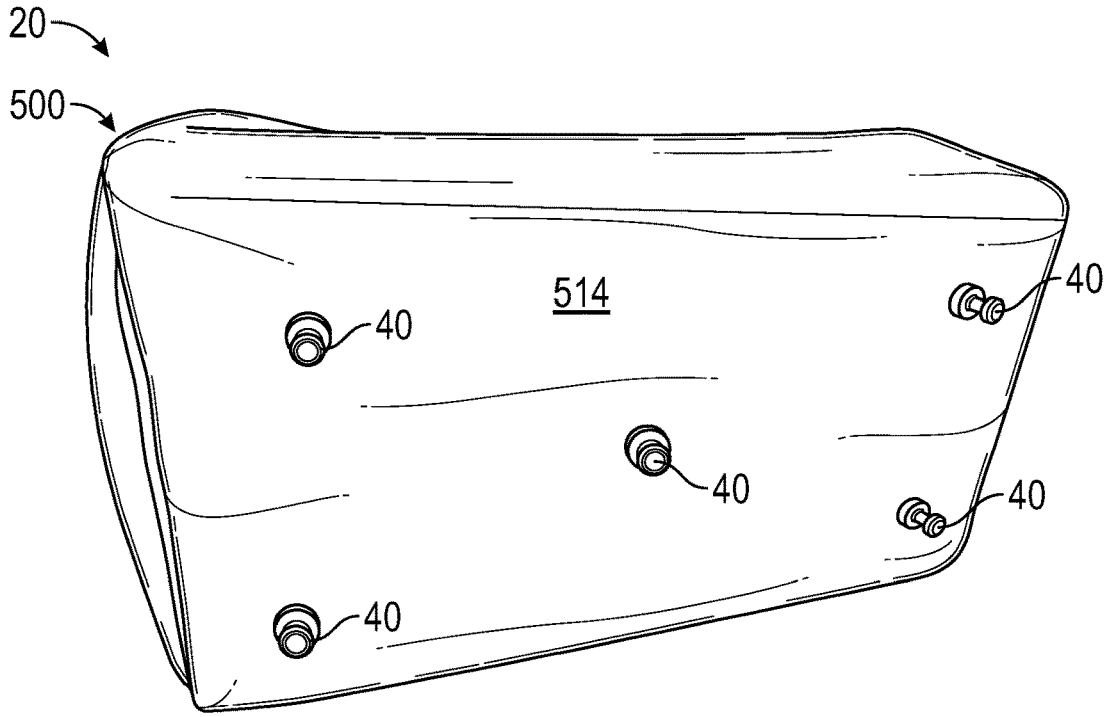
FIG. 24 is bottom perspective view of the FIG. 22 embodiment.

FIGS. 22-24 are front elevation, partial top plan, and bottom perspective views, respectively, of another embodiment of support system 20. Base shaper 30 is inserted into purse 500 and placed in contact with interior base surface 512 of the purse. Base shaper 30 is sized to substantially cover interior base surface 512, as best shown in FIG. 23. Base shaper 30 may contact interior sidewalls of the purse, or may not. In general, base shaper 30 is sufficiently sized to reduce sagging of the sidewalls. Base shaper 30 includes either magnets, ferromagnetic materials, or both. In the shown embodiment, base shaper 30 includes five distinct magnetically attractive regions 32. Five feet are provided, and are magnetically attachable to base shaper 30 through the base of purse 500 (i.e., the base of the purse being located between the base shaper and the feet).

In the embodiment of FIGS. 22-24, a purse support is not present. Alternatively, a purse support may also be included with support system 20 of this embodiment, for example the purse support of FIG. 6.

Figure 25:
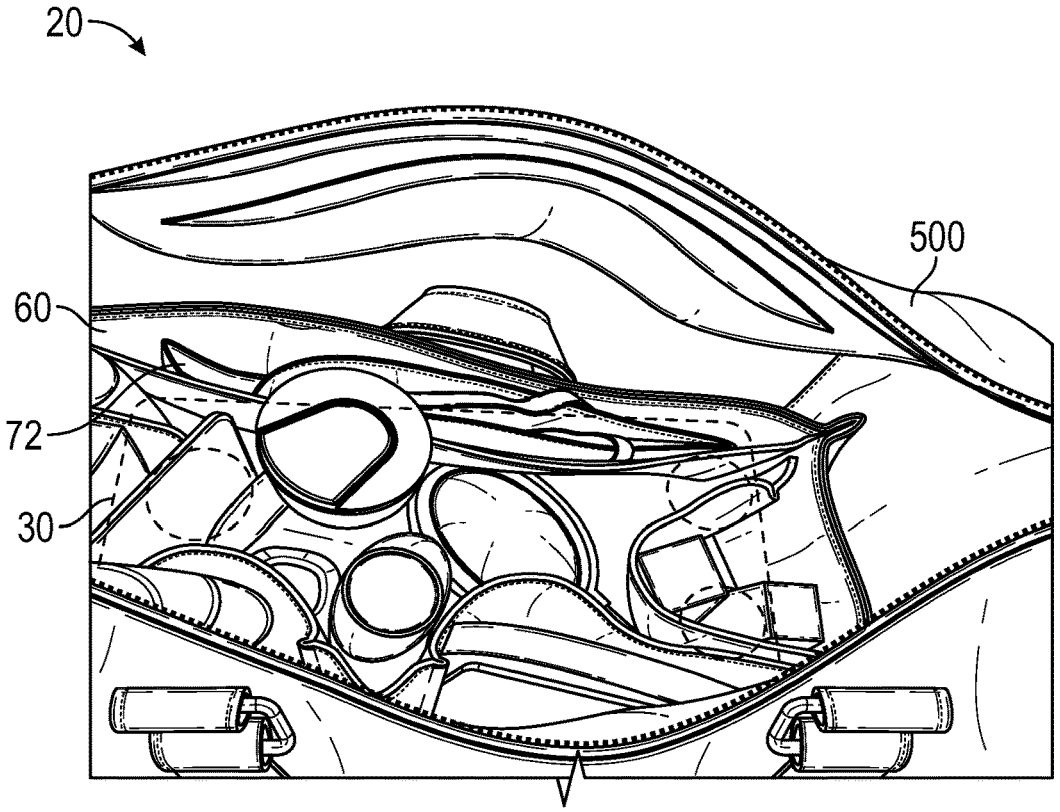
FIG. 25 is an enlarged partial top plan view of another embodiment of the support system, shown with cooperating environmental elements.

FIG. 25 is an enlarged partial top plan view an embodiment of support system 20, shown with cooperating environmental elements, such as cosmetics, toiletries, stationary items, etc. In this system, purse organizer 60 is used with base support 30. A sleeve 72, which may hold a purse support, is shown stored in purse organizer 60. It can be seen that all elements of the support system may be conveniently stored within purse 500 when not in use.

In another embodiment, base shaper 30 may additionally be used as a purse support 50.

In another embodiment, feet may be magnetically attached to a purse organizer through the base of the purse, without the use of a base shaper or a purse support.

Figure 26:
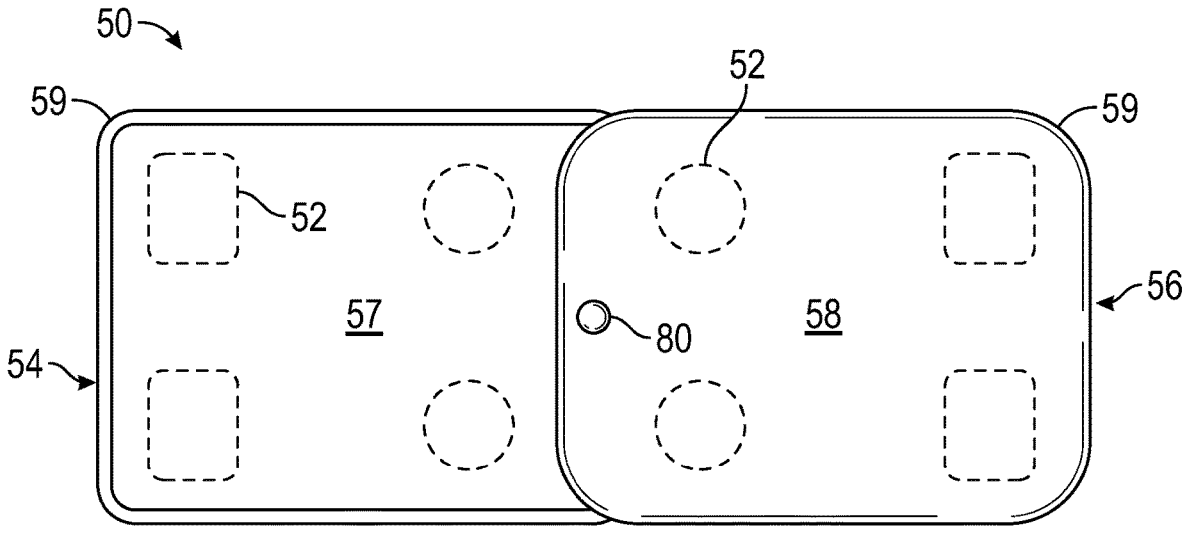
FIG. 26 is a top plan view of another embodiment of the purse support, in an unfolded position.
Figure 27:
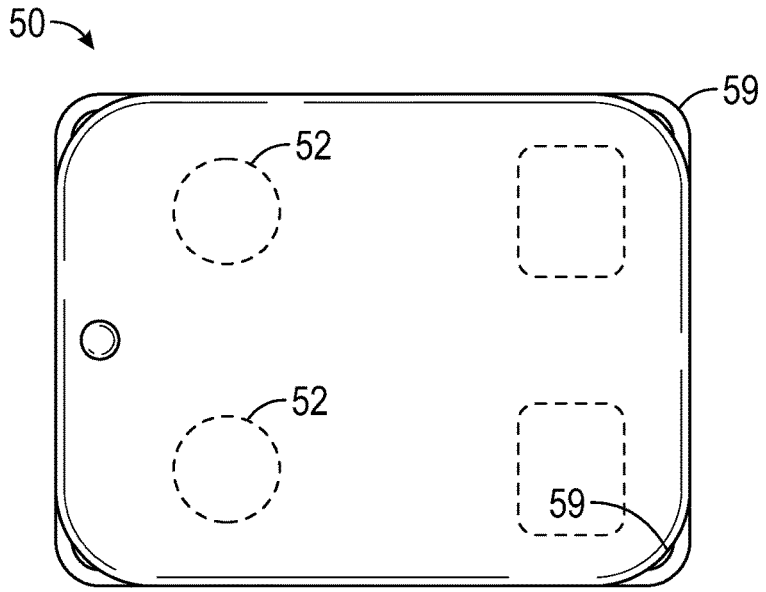
FIG. 27 is a top plan view of the embodiment of FIG. 26, in a folded position.

FIGS. 26 & 27 are top plan views of another embodiment of purse support 50, in an unfolded position and a folded position, respectively. As described above, purse support 50 is positionable between the folded position and the unfolded position by pivoting one of first member 57 and second member 58 about a retainer (e.g., thumbscrew 80). In the folded position, the shown embodiment of the purse support has a substantially rectangular shape. Corners 59 of the first and second members 57, 58 may be rounded and may have different radius of curvature on each member (as shown) or corners 59 may have the same radius of curvature (e.g., first and second members 57, 58 may have substantially the same perimeter shape). In the shown embodiment, purse support 50 includes eight distinct magnetically attractive regions 52 illustrated in hidden (dashed) lines. Some of the magnetically attractive regions 52 have a circular shape and some have a rectangular shape. In the shown arrangement, two magnetically attractive regions 52 are located near each of first end 54 and second end 56, while four additional magnetically attractive regions 52 are located near the center of purse support 50.

Figure 28:
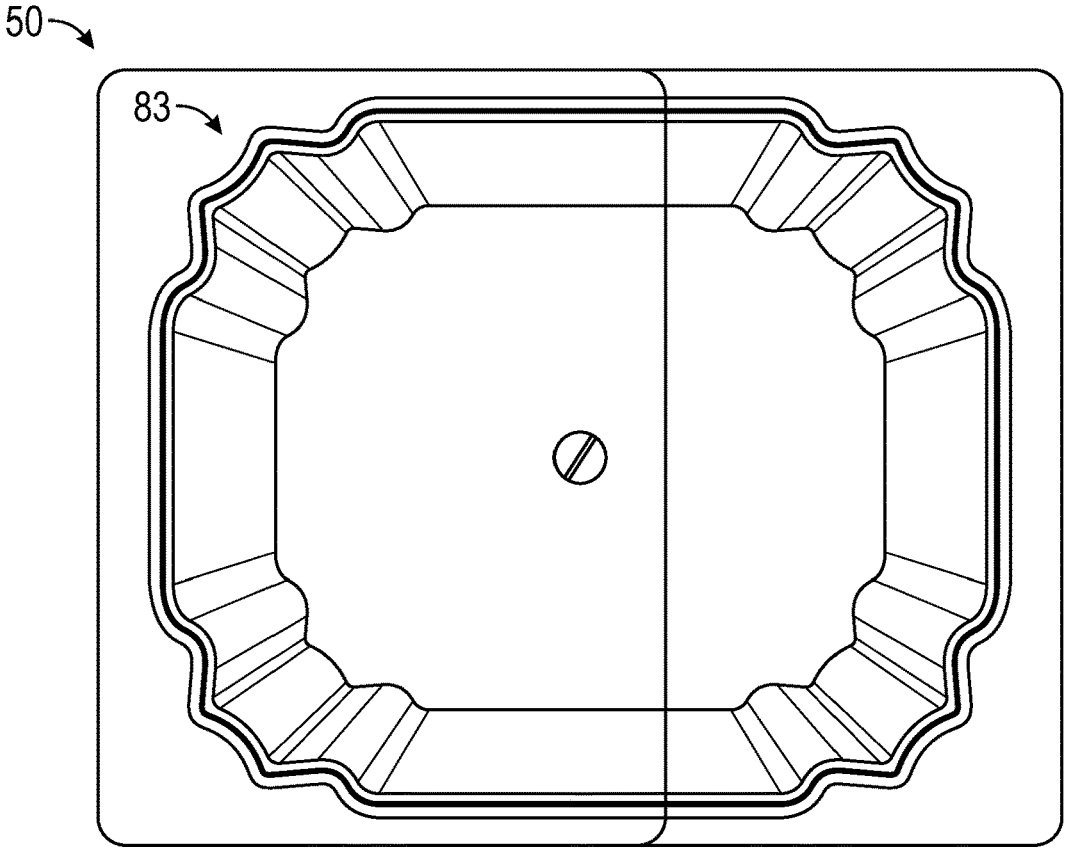
FIG. 28 is a top plan view of another embodiment of the purse support, in an unfolded position.

FIG. 28 is a top plan view of another embodiment of purse support 50 which has a decoration 83 on the support surface. The decoration 83 shown is artwork of a silver platter, which may be printed, painted, stamped, embossed, or otherwise applied to the surface of purse support 50. Embodiments of purse support 50 with decoration 83 may, or may not, include a folding feature as discussed above. Other examples of decoration 83 include: artwork of a cushion, custom artwork, lettering such as a user's initials, decorative patterns, or decorative edges.

Figure 29:
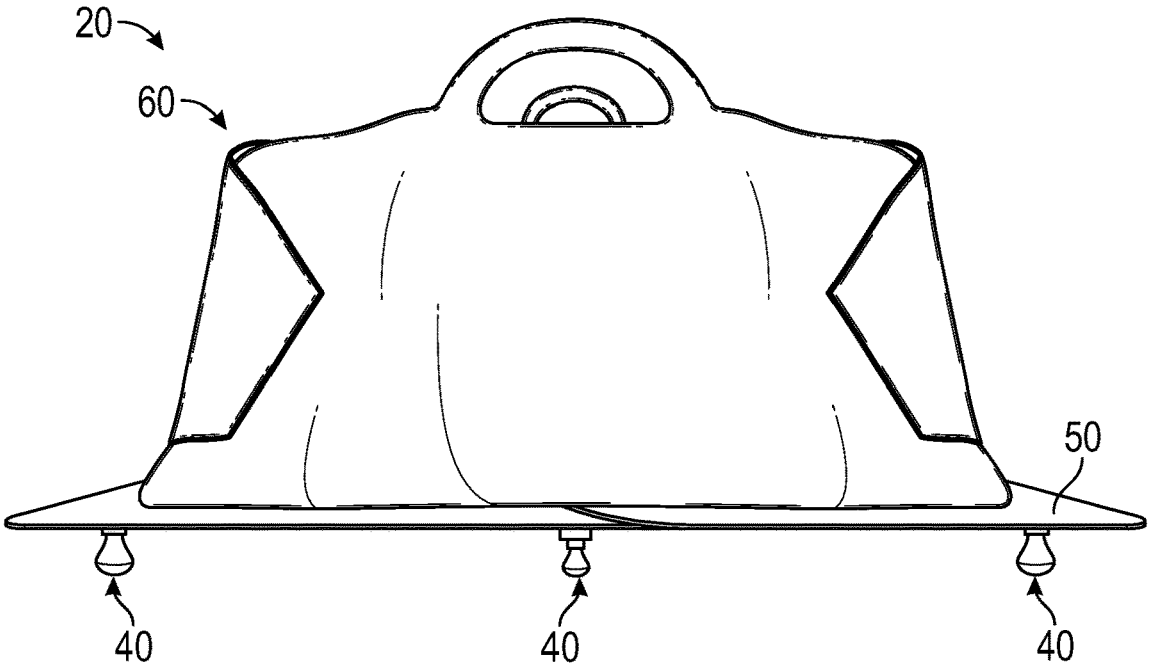
FIG. 29 is a front elevation view of another embodiment of the support system.

FIG. 29 is a front elevation view of another embodiment of support system 20, including a purse organizer 60, purse support 50, and a plurality of feet 40. As shown, support system 20 may be used to support purse organizer 60 without a purse. This embodiment may be particularly useful when a user is changing between purses, and desires to support a purse organizer offset from a surface. Alternatively, as described above, a purse may be used with the purse organizer 60 shown.

Figure 30:
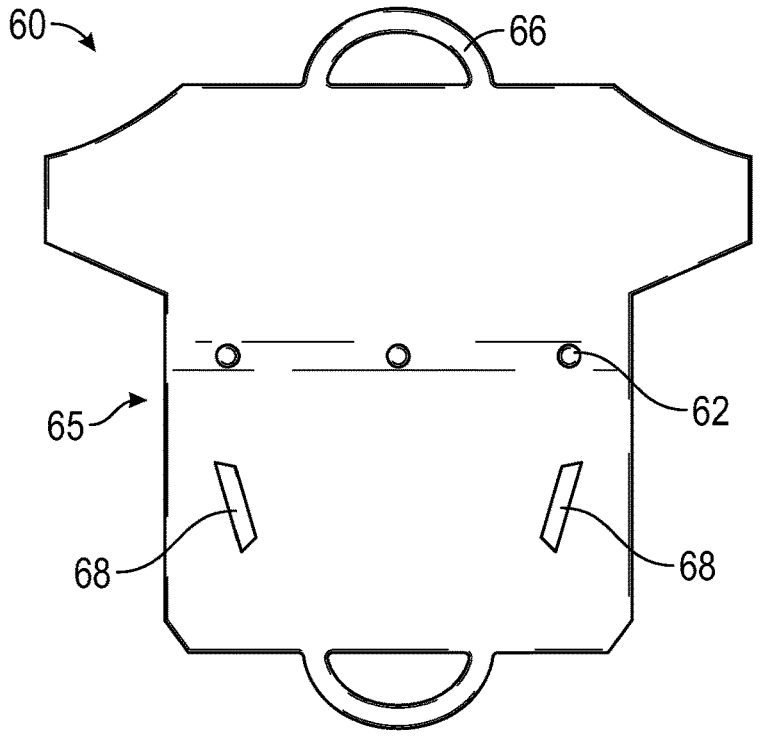
FIG. 30 is a plan view of an embodiment of the purse organizer in an expanded position, showing the exterior surface.
Figure 31:
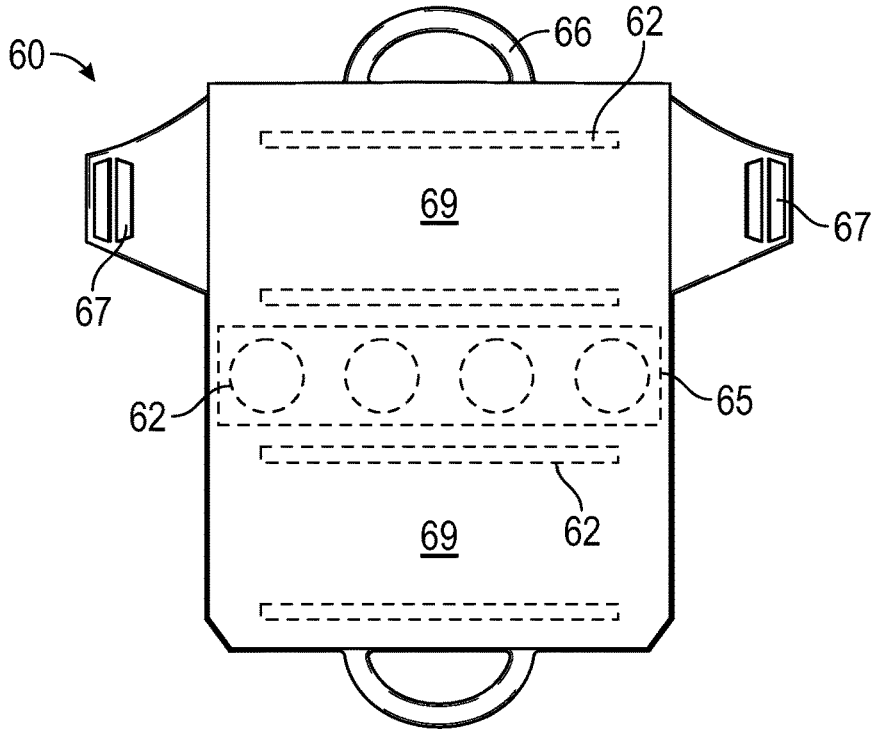
FIG. 31 is a plan view of an embodiment of the purse organizer in an expanded position, showing the interior surface.

FIGS. 30 & 31 are plan views of an embodiment of purse organizer 60 in an expanded position, showing an exterior surface and an interior surface, respectively. In the shown embodiment, purse organizer 60 may have an adjustably sized dimension, such as the width, which may be adjusted, for example, by engaging different regions of a first fastener 67 (on the interior surface) with a second fastener 68 (on the exterior surface) to configure the purse organizer as shown in FIG. 29. First and second fasteners 67 & 68 may be, for example, hook and loop fasteners, snaps, magnetically attractive regions, or the like.

The shown purse organizer 60 includes a plurality of magnetically attractive regions 62 on the bottom 65. The magnetically attractive regions 62 may be located on the exterior of bottom 65, as shown in FIG. 30, or may be internally located as shown in FIG. 31 (e.g., between layers of fabric or other materials). Purse organizer 60 may include several layers of material joined together, for example, suede, felt, leather, or other materials may be used. Materials of the interior surface and exterior surface may be different from one another, or they may be the same or similar to one another. Bottom 65 may include a rigid or semi-rigid piece, such as a cork base layer shown in FIG. 31. This base layer may be sandwiched between an internal surface material and an external surface material. In one embodiment, magnetically attractive regions 62 are connected to a base layer of bottom 65. In another embodiment, bottom 65 includes a layer of ferromagnetic material.

Figure 32:
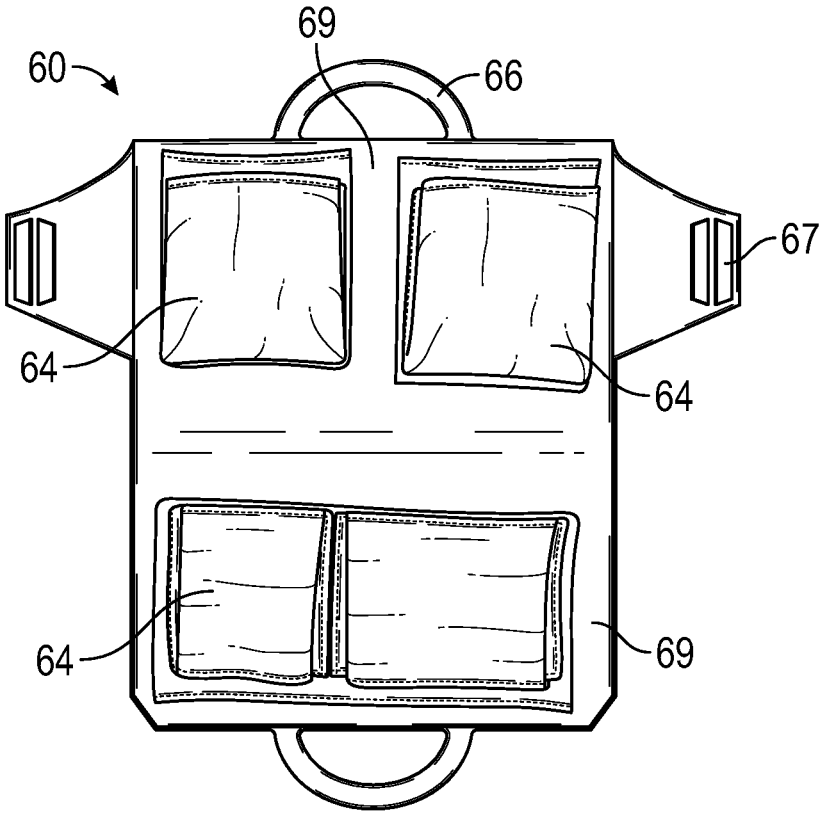
FIG. 32 is a plan view of another embodiment of the purse organizer in an expanded position, showing the interior surface.

FIG. 32 illustrates the interior surface of another embodiment of purse organizer 60 in an expanded position. Pockets 64 may be magnetically connectable to purse organizer sidewalls 69, such as by connection to magnetically attractive regions 62 located on or within purse organizer sidewalls 69 (see FIG. 31). By providing a plurality of magnetically attractive regions 62, or by instead or additionally providing one or more large magnetically attractive regions 62, pockets 64 may be removably or adjustably positionable within the purse organizer as desired by the user. One or more pockets 64 may be used with purse organizer 62. Three pockets 64 are shown in FIG. 32.

Further provided is a purse system, wherein support system 20 is packaged with a purse 500.

The embodiments of the support for a purse described herein are exemplary and numerous modifications, combinations, variations, and rearrangements can be readily envisioned to achieve an equivalent result, all of which are intended to be embraced within the scope of the appended claims. Further, nothing in the above-provided discussions of the support for a purse should be construed as limiting the invention to a particular embodiment or combination of embodiments. The scope of the invention is defined by the appended claims.

I claim:

1. A support system for supporting a purse in standoff relation to a surface, the purse having a base including an interior base surface and an exterior base surface, the support system comprising:

a base shaper configured for insertion into the purse and placement in contact with the interior base surface, the base shaper being substantially planar and sized to substantially cover the interior base surface, the base shaper including at least one of a magnet and a ferromagnetic material;

a plurality of feet, each of the feet having a top face configured for magnetic attachment to the base shaper with the base of the purse located between the base shaper and the plurality of feet, and each of the feet having a bottom face configured to contact the surface, whereby the purse is positionable in standoff relation to the surface; and a purse support configured for placement in contact with the exterior base surface of the purse with the purse resting upon the purse support and further configured for magnetic attachment to the base shaper and to the plurality of feet, the purse support including a first member and a second member connected to the first member by a retainer;

wherein the purse support is positionable into a folded position and an unfolded position by pivoting one of the first member and the second member about the retainer.

2. The support system of claim 1, wherein the purse support is a thin substantially planar member in each of the folded position and the unfolded position.

3. The support system of claim 1, wherein the retainer is configured to maintain the purse support in the folded position.

4. The support system of claim 1, wherein the purse support is shaped and dimensioned for concealment within the purse in the folded position.

5. The support system of claim 1, wherein the base shaper includes a plurality of distinct magnetically attractive regions.

6. The support system of claim 5, wherein the base shaper includes at least one magnetically attractive region proximate each of a first end and a second end of the base shaper.

7. The support system of claim 5, wherein the base shaper includes at least one magnetically attractive region substantially centrally located between a first end and a second end of the base shaper.

8. The support system of claim 5, wherein the base shaper includes from three to five magnetically attractive regions.

9. The support system of claim 1, wherein the plurality of feet includes from four to six feet.

10. The support system of claim 1, further including:

a purse organizer sized and dimensioned for concealment within the purse, the purse organizer configured for magnetic attachment to the base shaper.

11. The support system of claim 10, wherein the purse organizer includes at least two distinct magnetically attractive regions.

12. The support system of claim 1, further including:

each of the plurality of feet having a magnet proximate the top face.

13. The support system of claim 1, further including:

the base shaper having a plurality of distinct magnetically attractive regions, each of the magnetically attractive regions including a ferromagnetic material.

14. A support system for supporting a purse in standoff relation to a surface, the purse having a base including an interior base surface and an exterior base surface, the support system comprising:

a base shaper configured for insertion into the purse and placement in contact with the interior base surface, the base shaper being substantially planar and sized to substantially cover the interior base surface, the base shaper including at least one of a magnet and a ferromagnetic material;

a purse support configured for placement in contact with the exterior base surface of the purse with the purse resting upon the purse support and further configured for magnetic attachment to the base shaper with the base of the purse located between the base shaper and the purse support, the purse support including a first member and a second member connected to the first member by a retainer; and a plurality of feet, each of the feet having a top face configured for magnetic attachment to the purse support and a bottom face configured to contact the surface, whereby the purse is positionable in standoff relation to the surface;

wherein the purse support is positionable into a folded position and an unfolded position by pivoting one of the first member and the second member about the retainer.

15. The support system of claim 14, wherein the purse support is shaped and dimensioned for concealment within the purse in the folded position.

16. The support system of claim 14, wherein the purse support is shaped and dimensioned for concealment within the purse.

17. The support system of claim 14, wherein the purse support has a substantially flat shape in both the folded position and the unfolded position.

18. The support system of claim 14, wherein the plurality of feet are configured for magnetic attachment to the purse support with at least one of the plurality of feet located proximate each of a first end, a second end, and a central location of the purse support.

19. The support system of claim 1, wherein the purse support is positionable into the folded position by pivoting one of the first member and the second member about the retainer in a plane substantially parallel to the other one of the first member and the second member.

* * * * *